US011506451B2

(12) United States Patent
Jabou

(10) Patent No.: US 11,506,451 B2
(45) Date of Patent: Nov. 22, 2022

(54) APPARATUS FOR COOLING BOTTLED BEVERAGES

(71) Applicant: Kaelo Technology Ltd, London (GB)

(72) Inventor: Kevin Jabou, London (GB)

(73) Assignee: KAELO TECHNOLOGY LTD

( * ) Notice: Subject to any disclaimer, the term of this patent is extended or adjusted under 35 U.S.C. 154(b) by 0 days.

(21) Appl. No.: 16/076,941

(22) PCT Filed: Feb. 10, 2017

(86) PCT No.: PCT/GB2017/050367
§ 371 (c)(1),
(2) Date: Aug. 9, 2018

(87) PCT Pub. No.: WO2017/137774
PCT Pub. Date: Aug. 17, 2017

(65) Prior Publication Data

US 2019/0049173 A1 Feb. 14, 2019

(30) Foreign Application Priority Data

Feb. 10, 2016 (GB) ..... 1602402
Aug. 4, 2016 (GB) ..... 1613461

(51) Int. Cl.
*F25D 31/00* (2006.01)
*F25D 27/00* (2006.01)
(Continued)

(52) U.S. Cl.
CPC ..... *F25D 31/007* (2013.01); *A47B 13/16* (2013.01); *F25D 23/10* (2013.01); *F25D 27/005* (2013.01);
(Continued)

(58) Field of Classification Search
CPC ..... F25B 21/02; F25B 2321/02; F25B 2321/025; F25B 2321/803; F25D 31/007; F25D 23/10; A47B 13/16
See application file for complete search history.

(56) References Cited

U.S. PATENT DOCUMENTS 6,003,318 A * 12/1999 Busick ..... B67D 1/0869 62/3.64
7,089,749 B1 * 8/2006 Schafer ..... B60H 1/00264 62/3.2
(Continued)

FOREIGN PATENT DOCUMENTS

AU 2008100840 A4 11/2008
CN 1159853 A 9/1997
(Continued)

OTHER PUBLICATIONS

Behance: The Kaelo—Luxury Champagne Cooler on Behance May 6, 2014 (May 6, 2014), XP055372991, Retrieved from the Internet: URL:https://www.behance.net/gallery/16672133/The-Kaelo-Luxury-Champagne-Cooler.
(Continued)

*Primary Examiner* — Kun Kai Ma
(74) *Attorney, Agent, or Firm* — Fishman Stewart PLLC

(57) ABSTRACT

An apparatus for cooling bottled beverages may include an open-topped vessel defining a bottle chamber. The vessel may have a tubular wall and a base. The apparatus may further include a cooling device in thermal communication with the base of the vessel and with a heat exchanger. The apparatus may also include a tubular housing surrounding the vessel and enclosing the cooling device and the heat exchanger. Additionally, the apparatus may include a fan configured to provide an air flow along an airflow path. The
(Continued)

airflow path may extend from an inlet of the housing, across the heat exchanger, to an outlet of the housing.

19 Claims, 15 Drawing Sheets

(51) Int. Cl.

| | |
|---|---|
| ***F25D 23/10*** | (2006.01) |
| ***A47B 13/16*** | (2006.01) |
| ***A47B 31/02*** | (2006.01) |
| ***F25B 21/02*** | (2006.01) |
| ***F25D 29/00*** | (2006.01) |

(52) U.S. Cl.

CPC ..... *A47B 31/02* (2013.01); *F25B 21/02* (2013.01); *F25B 2321/02* (2013.01); *F25B 2321/025* (2013.01); *F25B 2321/0251* (2013.01); *F25B 2600/07* (2013.01); *F25D 27/00* (2013.01); *F25D 29/00* (2013.01); *F25D 2331/803* (2013.01); *F25D 2331/809* (2013.01); *F25D 2400/361* (2013.01); *F25D 2700/04* (2013.01); *F25D 2700/06* (2013.01)

(56) References Cited

U.S. PATENT DOCUMENTS

| | | | | |
|---|---|---|---|---|
| 2012/0312031 | A1* | 12/2012 | Olsen | F25B 21/02 62/3.62 |
| 2015/0135728 | A1* | 5/2015 | Swanson | F25B 21/02 62/3.64 |
| 2015/0191685 | A1* | 7/2015 | Kyle | C12C 12/00 99/277.1 |
| 2016/0201018 | A1* | 7/2016 | Watson | A47J 27/08 426/11 |
| 2016/0236605 | A1 | 8/2016 | Doi | |
| 2016/0364814 | A1* | 12/2016 | Yekutiely | G06F 16/9535 |
| 2017/0307282 | A1* | 10/2017 | Jelley | F25D 17/06 |
| 2017/0325609 | A1* | 11/2017 | Bhoir | F25D 31/008 |
| 2017/0356686 | A1* | 12/2017 | Xue | A47C 7/624 |

FOREIGN PATENT DOCUMENTS

| | | | | | |
|---|---|---|---|---|---|
| CN | 103885594 | A | | 6/2014 | |
| CN | 204473531 | U | | 7/2015 | |
| DE | 2415085 | C2 | | 6/1984 | |
| JP | H01109772 | U | | 7/1989 | |
| JP | H0825428 | A | | 1/1996 | |
| JP | 09061032 | A | * | 3/1997 | F25B 21/04 |
| JP | 2015058837 | A | | 3/2015 | |
| WO | WO-2011148182 | A1 | | 12/2011 | |

OTHER PUBLICATIONS

International search report for PCT/GB2017050367, dated Jun. 10, 2017.

First Chinese Office Action dated Mar. 23, 20 for copending Chinese Application No. 201780011004.1 (with machine English translation).

Second Chinese Office Action dated Nov. 6, 20 for copending Chinese Application No. 201780011004.1 (with machine English translation).

Machine English translation for CN1159853.

Machine English translation for JPH0825428.

Chinese Office Action dated May 24, 2021 for copending Chinese App. No. 201780011004.1 (including English translation).

* cited by examiner

APPARATUS FOR COOLING BOTTLED BEVERAGES

CROSS REFERENCE TO RELATED APPLICATIONS

This application claims priority to International Application No. PCT/GB2017/050367 filed on Feb. 10, 2017, Great Britain Application No. GB 1602402.8 filed on Feb. 10, 2016 and Great Britain Application No. GB 1613461.1 filed on Aug. 4, 2016, the contents of each of which are hereby incorporated by reference in their entirety.

TECHNICAL FIELD

The invention relates to apparatus for cooling bottled beverages. More specifically, the invention relates to apparatus capable of keeping champagne and wine bottles cool for extended periods of time.

BACKGROUND

Luxury spirits and fine wines are best experienced under specific conditions. For example, it is well known that champagne should be drunk at a temperature in the range of 7° C. and 10° C. It is therefore desirable to maintain the contents of a bottle within a desired temperature range. Moreover, the bottle must also be correctly cooled or warmed, as rapid change may damage the contents, rendering them unpleasant to consume or even undrinkable.

Prior to opening, bottle temperatures are easily regulated by storing the bottle in a wine fridge or cellar. However, as the environment in which the beverage is to be drunk is likely to be warmer, removing the bottle from the fridge or cellar immediately begins a warming process. The temperature of the beverage must be regulated correctly during this period between opening and pouring/drinking.

Currently, a flawed (but popular) solution to this problem is to use an ice bucket—a container filled with water and ice into which the bottle is placed. Unfortunately, ice buckets are unsightly, difficult to move, and inconvenient, taking up a large amount of table top space. Also, as temperature regulation is not possible with an ice bucket, the drink temperature may drop well below the optimal temperature before rising again as the ice melts. When the ice has melted, the water will return to room temperature, bringing the temperature of the bottle to room temperature with it. Therefore, there is a very small window in which the bottle's contents are at the correct temperature.

A different, more effective, approach is seen in the Applicant's application WO 2011/148182, which describes a powered bottle-cooling device that provides an alternative to an ice bucket. The device is suspended from a supporting lip, and has an open-topped internal chamber that is cooled thermoelectrically. The device disclosed in WO 2011/148182 is efficient in operation but suffers from some problems. The present invention has been devised to overcome those problems and to provide improvements over the prior art.

SUMMARY

According to an aspect of the invention, there is provided apparatus for cooling bottled beverages, the apparatus comprising: a hang-off structure surrounding an access opening for receiving a bottle in use; an open-topped vessel defining a bottle chamber accessible through the access opening, the vessel comprising a tubular wall coupled to the hang-off structure and a closed base opposed to the access opening; a heat exchanger; and a cooling device having a heat input side in thermal communication with the base of the vessel and a heat output side in thermal communication with the heat exchanger; wherein the heat exchanger is suspended from the base of the vessel to define a load path extending from the hang-off structure to the heat exchanger via the wall and the base of the vessel.

Beneficially, cooling apparatus as described above provides structurally stable apparatus that may be suspended from a surface without excessive strain or stress on any component part of the apparatus. This is achieved by a distribution of forces through the apparatus.

Furthermore, by suspending the heat exchanger from the vessel, the separation between cooling device, vessel and heat exchanger can be minimized to improve thermal performance. This suspension also reduces the weight and size of the required fixings.

The apparatus may comprise an annular frame. The annular frame may be coupled to the vessel, and may be coupled to the hang-off structure. Incorporating a frame further improves the distribution of forces throughout the apparatus, ensuring that the structural stability of the apparatus is maintained.

Optionally, the frame is coupled to the hang-off structure by cooperating threads. The cooperating threads may comprise a male thread on the hang-off structure. The cooperating threads may comprise a female thread on the frame.

The apparatus may further comprise a circumferential seal. The circumferential seal may be incorporated into a peripheral groove in an external face of the frame. Advantageously, a circumferential seal ensures that in use, when suspended from a mounting surface, the apparatus is stable suspended. The seal also protects the apparatus from liquid spillages that may occur.

The frame may comprise a male thread that encircles the frame. The male thread may be co-operable with a clamp ring arranged to be advanced along that male thread toward the hang-off structure. The clamp is particularly useful in further stabilising the apparatus when suspended from a mounting surface, and ensures that the apparatus cannot easily be removed from the surface. The clamp also ensures that movement of the apparatus is minimized when subjected to different loads.

The frame may comprise an annular flange that extends radially inwardly to cooperate with the vessel. The vessel may have a radially-outwardly projecting lip that hangs on the flange. The lip may be clamped between the hang-off structure and/or the flange. These features further improves the distribution of load throughout the apparatus. Clamping the lip between the hang-off structure and/or the flange allows for a seamless bottle chamber and allows the frame to be hidden from view in use.

There may be a gap between the vessel and the hang-off structure. The gap may be on a radially inner side of the hang-off structure. An annular optical element may be disposed in the gap. A light path may extend from the optical element to a lighting system disposed between the hang-off structure and the frame. The optical element may be clamped between the hang-off structure and the frame.

The frame may comprise an annular skirt. The annular skirt may be spaced radially from the tubular wall of the vessel to define an annular recess between the skirt and the wall. A tubular insulator that surrounds the vessel may be disposed in the recess.

The apparatus may comprise a housing that encircles the vessel. The housing may be coupled to the hang-off structure. The housing may be coupled to the hang-off structure via the frame. The housing is particularly advantageous as is creates a seamless outer surface of the apparatus, and further protects the entire apparatus. For example, the apparatus may be accidentally kicked in use, and the incorporation of a housing ensures that this does not damage any of the components of the apparatus.

The housing and the frame may be coupled telescopically. A skirt depending from the frame may have complementary co-axial curvature with respect to the housing. The frame may be made of a thermally insulative polymer material. Beneficially, a thermally insulative sleeve improves the performance of the apparatus in cooling bottles by isolating the vessel and reducing thermal conduction away from the vessel.

Optionally, the cooling device may be held against the base of the vessel by the heat exchanger. The heat exchanger may be suspended directly from the base of the vessel, and may be suspended from the base of the vessel by axially-extending fixings.

The axially-extending fixings may extend through the base of the vessel. The axially-extending fixings may be concealed by a cover on a side of the base facing into the vessel. The cover may be received in a recess in the base of the vessel and may define a substantially flush inner surface of the base of the vessel. The heat exchanger may be suspended from the base of the vessel via the cooling device.

According to another aspect of the invention, there is provided apparatus for cooling bottled beverages, the apparatus comprising: an open-topped vessel defining a bottle chamber, the vessel having a tubular wall, a longitudinal axis and a closed base; a heat exchanger spaced longitudinally from an external surface of the base of the vessel to define a gap between that external surface and the heat exchanger; a thermally-insulating insert disposed in the gap; a cooling device having a heat input side in thermal communication with the base of the vessel and a heat output side in thermal communication with the heat exchanger; and a thermal bridge in thermally-communicative contact with the cooling device as part of a heat flow path extending from an internal surface of the base of the vessel to the heat exchanger, the thermal bridge being disposed beside the insert such that a plane orthogonal to the longitudinal axis extends through the thermal bridge and the insert.

Beneficially, the combination of a thermal bridge and thermally-insulating insert between the cooling device and the base of the vessel improves the cooling efficiency and cooling potential of the apparatus so that the temperature of the vessel can be maintained for longer and with less operational strain on the cooling device. When considered in more detail, the thermal bridge increases the separation between the heat exchanger and the vessel, ensuring that a controlled conducting area is exposed to the cooling device and heat exchanger. If the thermal bridge was not included, then the cooling effect of the cooling device may be negated by the heat dissipated from the heat exchanger re-heating the vessel. Similarly, the insert provides a substantial insulating separation between the heat exchanger and the vessel.

The thermal bridge may be integral with the base of the vessel. Integrating the base and thermal bridge reduces losses experienced along the heat flow path.

At least a distal portion of the thermal bridge in thermally-communicative contact with the cooling device may be narrower about the longitudinal axis than a peripheral portion of the base. The peripheral portion of the base may extend transversely with respect to the longitudinal axis and the thermal bridge extends longitudinally. The thermal bridge may be thicker longitudinally than the peripheral portion of the base.

These features further improve the separation between heat exchanger and vessel base.

The heat input side of the cooling device may be in thermal contact with the thermal bridge. The heat output side of the cooling device may be in thermal contact with the heat exchanger.

A thermally-insulating sleeve may surround the vessel.

The thermally-insulating insert disposed in the gap may be integral with the sleeve. The thermally-insulating insert may form an insulator cup. The insulator cup may have an L-shaped longitudinal section in which the insert extends inwardly from the sleeve toward the longitudinal axis. An L-shaped insulator cup allows the shapes of the insulator cup and thermal bridge to be properly tailored to achieve the separation between heat exchanger and vessel base.

The vessel and the thermal bridge may have rotational symmetry about the longitudinal axis. The thermally-insulating insert may have rotational symmetry about the longitudinal axis. The thermally-insulating insert may surround the thermal bridge in said plane orthogonal to the longitudinal axis. The thermally-insulating insert may have an annular cross-section in said plane.

The apparatus may comprise a reservoir for liquid. The reservoir may be in thermal contact with the heat output side of the cooling device. The apparatus may comprise a liquid circulation path between the reservoir and heat exchange formations of the heat exchanger. Liquid cooling improves the cooling effect of the heat exchanger considerably by ensuring a steady heat flow away from the hottest areas, either by convection or by the use of a pump.

According to another aspect of the invention, there is provided apparatus for cooling bottled beverages, the apparatus comprising: an open-topped vessel defining a bottle chamber, the vessel having a tubular wall and a base; a cooling device in thermal communication with the base of the vessel and with a heat exchanger; a tubular housing surrounding the vessel and enclosing the cooling device and the heat exchanger; and a fan configured to cause air to flow, in use, along an airflow path that extends from an inlet of the housing and across the heat exchanger to an outlet of the housing.

Air flow across a heat exchanger is particularly important to maintain a constant and efficient dissipation of heat to the surrounding atmosphere. The fan must also be able to expel the heated air such that the re-heating of the apparatus does not disrupt the cooling provided by the cooling device. The apparatus including a fan configured to cause air to flow along an airflow path as described provides advantageous heat dissipation properties, by specifically directing the heated air from the heat exchanger to an outlet, and by drawing cool air from an inlet to the heat exchanger. In this way, air is moved efficiently and quickly across the heat exchanger.

One of the inlet or the outlet may extend through a tubular wall of the housing and the other of the inlet or outlet may be surrounded by that tubular wall.

One of the inlet or the outlet may extend substantially continuously around the tubular wall of the housing.

The apparatus may comprise an external duct coupled to and extending longitudinally from the housing in communication with the inlet or outlet that is surrounded by the tubular wall of the housing. An external duct is particularly useful in directing heated air away from the apparatus, or directing cool air towards it.

The apparatus may comprise at least one air flow guide within the housing. The air flow guide may be shaped to deflect air flow following the airflow path from the inlet toward the outlet either from substantially axial inward flow to cross-axial outward flow or from cross-axial inward flow to substantially axial outward flow.

The inlet and the outlet may both extend through a tubular wall of the housing. The inlet and the outlet may be diametrically opposed about a longitudinal axis of the tubular housing.

The inlet and/or the outlet may comprise a honeycomb array of substantially hexagonal apertures that penetrate the housing. A honeycomb array is a particularly efficient use of material, allowing for a large open area for drawing air through, whilst retaining the required strength within the housing.

According to another aspect of the invention, there is provided apparatus for cooling bottled beverages, the apparatus comprising: a bezel surrounding an access opening for receiving a bottle in use, which bezel constitutes, or covers, a hang-off structure; an open-topped vessel connected to the hang-off structure, the vessel defining a bottle chamber accessible through the access opening; a cooling device arranged to cool the vessel; and a control system that is connected electrically to the bezel and is configured to change an operating condition of the apparatus in response to user interaction with the bezel, which user interaction changes electrical capacitance of a capacitive touch sensor surface of the bezel.

Incorporating a control system to the apparatus is particularly useful in allowing the user to control the device in a clear and easy way without the need for additional and unnecessary buttons or switches. As the apparatus, in use, will be substantially hidden, the use of the visible features to control the device improves the user experience.

The control system may be connected electrically to the cooling device. The operating condition of the apparatus may be an operating condition of the cooling device. For example, the apparatus may be activated using an interaction, the user may alter the temperature, or the scheduling of the apparatus may be changed.

The control system may be electrically connected to a lighting system. The operating condition of the apparatus may be an operating condition of the lighting system. The customisability of the apparatus further enhances the user experience.

The control system may be configured to change said operating condition of the apparatus in response to a user interaction. The user interaction may comprise performing at least one tap action on the bezel.

The control system may be configured to change said operating condition of the apparatus in response to a first user interaction. The first user interaction may comprise performing a first set of tap actions on the bezel within a time window.

The control system may be configured to change said operating condition of the apparatus in response to a second user interaction. The second user interaction may comprise performing a second set of tap actions on the bezel within a time window, which second set of tap actions is different to the first set of tap actions. Providing multiple user interactions in the form of a series of taps increases the potential uses of the apparatus, increasing the likelihood of continued use by the user. The user experience is further enhanced by a customisable control system.

The control system may be configured to maintain the operating condition of the apparatus in a changed state for a predetermined time period.

The control system may be configured not to change the operating condition of the apparatus if a user interaction with the bezel occurs during the predetermined time period.

The control system may be configured to revert the operating condition of the apparatus to a preceding operating condition when the predetermined time period has elapsed.

The control system may be configured to change the operating condition of the apparatus in response to said user interaction with the bezel only after the predetermined time period has elapsed.

According to another aspect of the invention, there is provided an item of furniture fitted with the apparatus as described above.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described, by way of example only, with reference to the accompanying drawings, in which.

DETAILED DESCRIPTION

Figure 1:
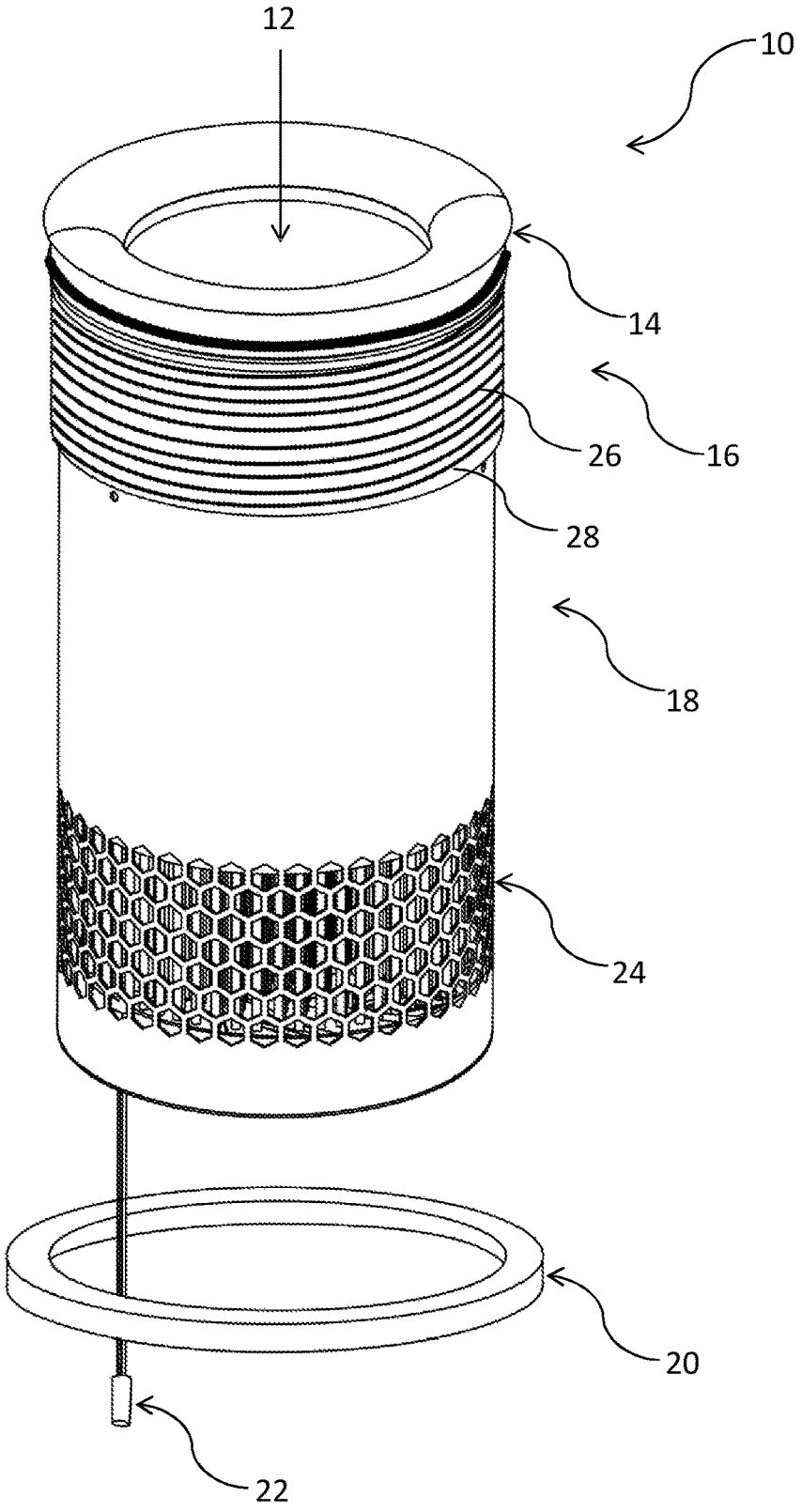
FIG. 1 is a perspective view of cooling apparatus according to the present invention.

The present invention relates to apparatus 10 of the type exemplified in FIG. 1 that can be installed into, and seamlessly integrate with, an item of furniture, a vehicle interior, or other preferably planar solid panels. The apparatus 10 is generally used to maintain the temperature of the contents of a drinks bottle before and after the bottle has been opened. As can be seen in FIG. 1, the apparatus 10 is substantially cylindrical, and includes an open-topped, cylindrical bottle chamber 12 into which at least a major lower portion of a bottle can be placed.

The apparatus 10 of FIG. 1 further comprises a frame 16, a casing or housing 18, a clamp ring 20, a power cable 22 and a hang-off structure including a rim or bezel 14. The bezel 14 enables suspension of the apparatus 10 through a hole in the panel in which the apparatus 10 is fitted, while the housing 18 protects the apparatus 10 from accidental kicks or knocks. The housing 18 incorporates staggered, interlocking hexagonal apertures 24 that help to improve the efficiency of the apparatus 10 by maximising air flow while making efficient use of material and retaining the strength necessary for the housing 18. A thread 26 is incorporated into the outer surface 28 of the frame 16 for engaging the clamp ring 20 so that the clamp ring 20 can be advanced up the thread 26 to fix the apparatus 10 in place within the hole. With the clamp ring 20 removed, the apparatus 10 may easily be moved or removed.

Figure 2:
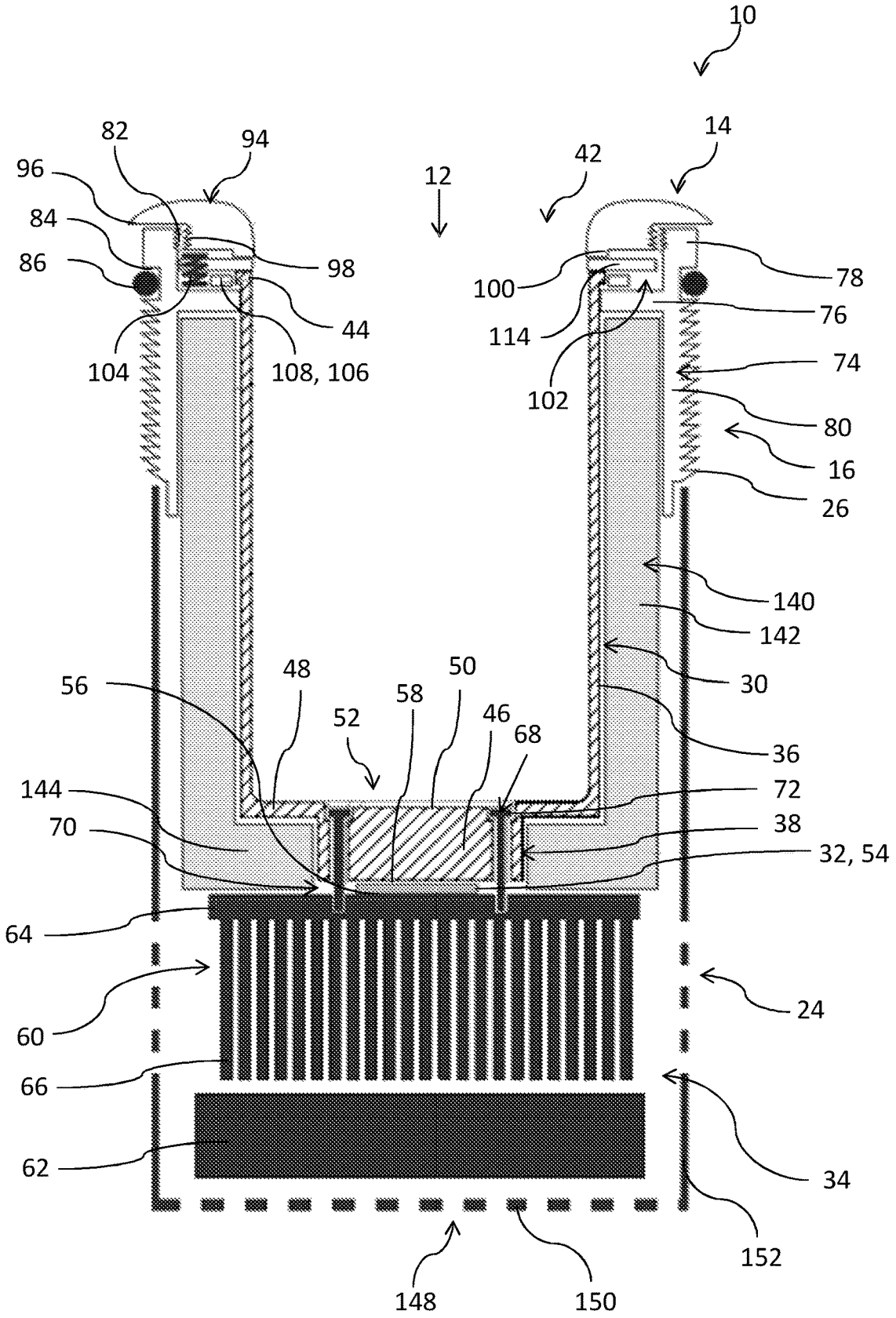
FIG. 2 is a side view of the apparatus of FIG. 1 in longitudinal section.

Referring now to FIG. 2, the apparatus 10 includes a cooling vessel 30, a cooling system 32 and a heat dissipation system 34. The cooling vessel 30 comprises a tubular chamber wall 36 and a base portion 38, inner surfaces of each together largely defining the bottle chamber 12. The cooling vessel 30 is open-topped, defining a mouth 42 of the top of the apparatus 10 and characterising the bottle chamber 12 as having a generally U-shaped longitudinal section.

It will be appreciated that references to upper and lower, for example, are not intended to be limiting and relate only to the orientation of the assembly as shown in the illustrations, which will generally coincide with the orientation of use.

The chamber wall 36 of the cooling vessel 30 comprises a small supporting lip 44 disposed at, and extending radially outwards a short distance from, the upper edge of the tubular chamber wall 36. The base portion 38 comprises a central portion 46 and a flange 48 extending radially outward from the central portion 46 towards the chamber wall 36. The base portion 38 is disposed such that the lower edge of the chamber wall 36 joins the flange 48 of the base portion 38, and such that the outer surfaces of both the chamber wall 36 and flange 48 are aligned. Thus, an outer diameter of both the chamber wall 36 and flange 48 are equal. A covering plate 50 is placed into a shallow cylindrical recess 52 disposed centrally in the upper surface of the base portion 38, as will be discussed later.

The material from which the cooling vessel 30 is manufactured has excellent thermal conductivity and a tensile strength high enough to ensure that the cooling vessel 30 can be suspended from the lip 44 and hold a bottle without warping. For example, aluminium alloys may be used as the vessel 30 material. In the present embodiment, the vessel 30 is manufactured as a single item to optimise thermal conduction between the chamber wall 36 and the base portion 38. However, if desired, it would be simple to manufacture the base portion 38 and chamber wall 36 separately and join the components with screws or an adhesive. The vessel 30 is suitably anodised prior to assembly of the apparatus 10 in order to reduce marking, wear, or corrosion of the vessel 30 during use. Condensation and ice build-up may be reduced by a hydrophobic coating that is applied to the vessel 30 prior to assembly of the apparatus 10. In addition, the corner formed between the chamber wall 36 and the base portion 38 may be rounded in section to enable the bottle chamber 12 to be easily cleaned.

The cooling system 32, typically comprising a thermoelectric cooling device or Peltier device 54, is sandwiched between the heat dissipation system 34 and the cooling vessel 30, an upper surface of the cooling system 32 abutting the lower surface of the central portion 46 of the cooling vessel 30 in thermal contact. Thermoelectric cooling devices use the Peltier effect to transfer heat from one side of the device to the other, such that the device has a hot side 56 and a cold side 58. The surface of the vessel 30 that is in contact with the cooling system 32 is preferably lapped so as to be as flat as possible, matching the flat upper surface of the cooling system 32. This increases the surface contact between the cooling system 32 and vessel 30, improving the thermal transfer between them.

The heat dissipation system 34 comprises a heat exchanger, which comprises a heat sink 60, and a cooling fan 62. The heat sink 60 includes a main body 64 and a plurality of heat dissipation elements 66 that extend from the main body 64. The hot side 56 of the thermoelectric cooling device 54 is in contact with the main body 64 of the heat sink 60. Heat transferred by the cooling action of the cooling device 54 is transferred to the main body 64 and in turn to the plurality of heat dissipation elements 66 of the heat sink 60. The heat sink 60 aids in the dissipation of heat from the cooling device 54 by providing a large exposed surface area by virtue of the heat dissipation elements 66. The upper surface of the main body 64 of the heat sink 60 that is in contact with the cooling device 54 is preferably lapped to improve the thermal transfer from the cooling device 54 to the heat sink 60, by matching a flat lower surface of the cooling device 54.

The cooling device 54 dissipates heat to the heat sink 60 across a small area of contact only, owing to the relative difference in size between the upper surface of the heat sink 60 and the cooling device 54. In order to increase the efficiency of the system, alternative heat sink arrangements can be incorporated to dissipate heat away from the device evenly and quickly. These alternatives are discussed in more detail later, with reference to FIGS. 5 to 8.

Focusing still on FIG. 2, the heat sink 60 is fixed to and suspended from the cooling vessel 30 by a plurality of fixings such as screws 68. A shallow void 70 between the cooling vessel 30 and heat sink 60 is deep enough to incorporate the cooling device 54. The screws 68 extend through the base portion 38 of the cooling vessel 30 into the heat sink 60. The heads 72 of the screws 68 are positioned at the edges of the central recess 52 in the base portion 38. The covering plate 50 is placed into the recess 52 and covers the heads 72 of the screws 68. The covering plate 50 protects against moisture damage to the screws 68, the cooling device 54 and heat sink 60, and provides easy access to the screws 68 in the event that disassembly and/or maintenance is required. The covering plate 50 also hides the screws 68 and may bear indicia such as a trade mark, creating a visually appealing chamber base. It should be noted that the diameter of the central portion 46 of the base portion 38 is dimensioned to be as small as possible in order to reduce the thermal mass and aid in cooling the vessel 30. The central portion 46 can therefore be thought of as a thermal bridge between the internal surface of the vessel 30 and the cooling device 54.

The cooling vessel 30 is suspended from the frame 16 by its supporting lip 44. The frame 16 is formed of an annular outer ring 74 and a shelf 76 that extends radially inwardly from the outer ring 74. The outer ring 74 comprises an upper portion 78 and a lower portion 80. The upper portion 78 of the outer ring 74 incorporates an inwardly-facing female thread 82. A circumferential groove 84 is defined in the outer face of the upper portion 78, into which a rubber sealing ring 86 is fitted. The sealing ring 86 seals against a panel into which the apparatus 10 is fitted. The lower portion 80 of the outer ring 74 incorporates an outwardly-facing male thread 26 onto which the clamp ring 20 may be threaded, as will be discussed later. The shelf 76 extends radially inward towards the cooling vessel 30 from the annular outer ring 74.

The frame 16 is constructed from a thermoplastic with good thermal stability and moisture resistance, such as polyoxymethylene. The advantage of a material such as polyoxymethylene is twofold. Firstly, plastics are good thermal and electrical insulators and therefore use of plastics as the frame material ensures that the apparatus 10 is as well insulated as possible. Secondly, the advantage over other synthetic polymers is that when exposed to fluctuations in temperature, a material like polyoxymethylene expands and contracts much less. This ensures that any threaded elements do not seize or warp during operation.

The mouth 42 of the apparatus 10 is defined by the bezel 14. The bezel 14 has an inner and outer diameter and comprises a rounded upper surface 94, a radially outer bezel lip 96, a male thread 98, and a radially inner skirt 100.

The male thread 98 of the bezel 14 engages the female thread 82 of the upper portion 78 of the outer ring 74. An annular channel 102 is defined between the shelf 76 and the skirt 100. A plurality of compression springs 104 and a light source 106, comprising an annular LED PCB board 108, are provided in the annular channel 102, between the lip of the vessel 30 and the upper portion 78 of the outer ring 74.

Figure 3:
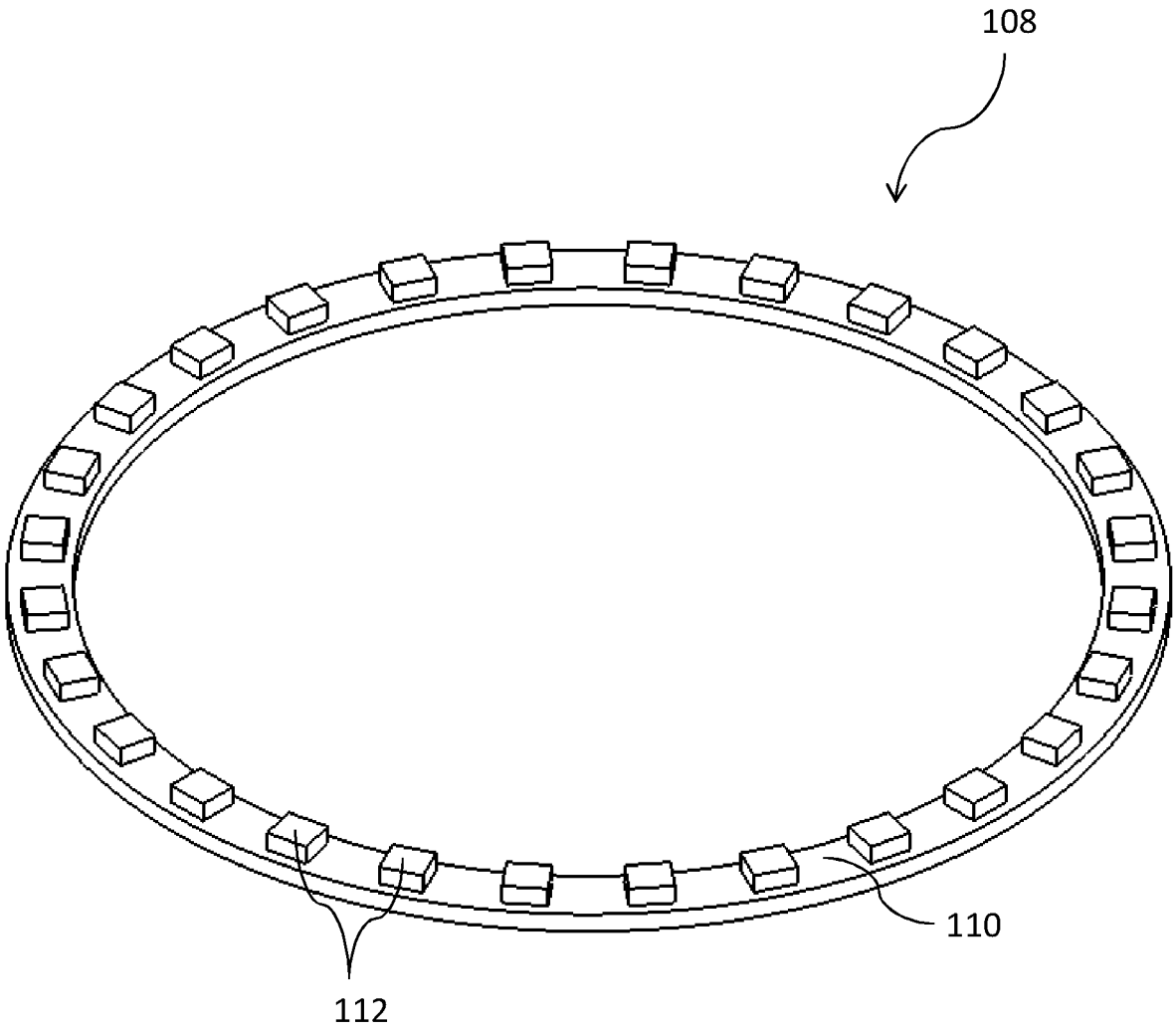
FIG. 3 is an isometric view of an LED PCB board incorporated into the apparatus of FIG. 1.

The LED PCB board 108 is shown in more detail in FIG. 3, and comprises an annular PCB board 110 and a plurality of LEDs 112 angularly spaced around the board to distribute their light output. The annular shape of the board 110 makes assembly simple, and provides an easily replaceable part if a fault occurs.

Returning to FIG. 2, an annular, transparent or translucent optical element 114, suitably manufactured from Perspex or a similar plastic, is positioned on top of the light source 106 and sandwiched between the skirt 100 of the bezel 14 and the lip of the vessel 30, such that light from the LEDs 112 shines through the optical element 114 and into the chamber 12. The inner diameter of the optical element 114 is equal to that of the inner diameter of the vessel 30 and so forms part of the chamber 12.

As the skirt 100 sandwiches the optical element 114 against the lip 44 of the vessel 30 as the bezel 14 threads into the frame 16, this clamps the lip 44 to the shelf 76 of the frame 16 and secures the cooling vessel 30 firmly in place. The inner diameter of the bezel 14 is equal to the internal diameter of the vessel 30 and of the optical element 114.

The springs 104 form a connection between the bezel 14 and a plurality of capacitive contacts (not shown). The springs 104 are not connected directly to the bezel 14 and so the twisting movement that results when connecting the frame 16 and bezel 14 simply compresses the springs 104. In compressing the springs 104, the required electrical connection is formed to create a touch sensor by a connection between the bezel 14, springs 104, and a central processing unit (CPU) (not shown) on a circuit board (not shown). This enables touch control capabilities to be implemented on the apparatus 10. In contrast, when using a cable connection, attachments between the cable and bezel 14, or between the cable and subsequent components could be stressed or destroyed by the twisting of the bezel 14. Using springs 104 provides a simple assembly and manufacturing method. The CPU and circuit board will be discussed in more detail later with reference to FIG. 11.

Figure 4:
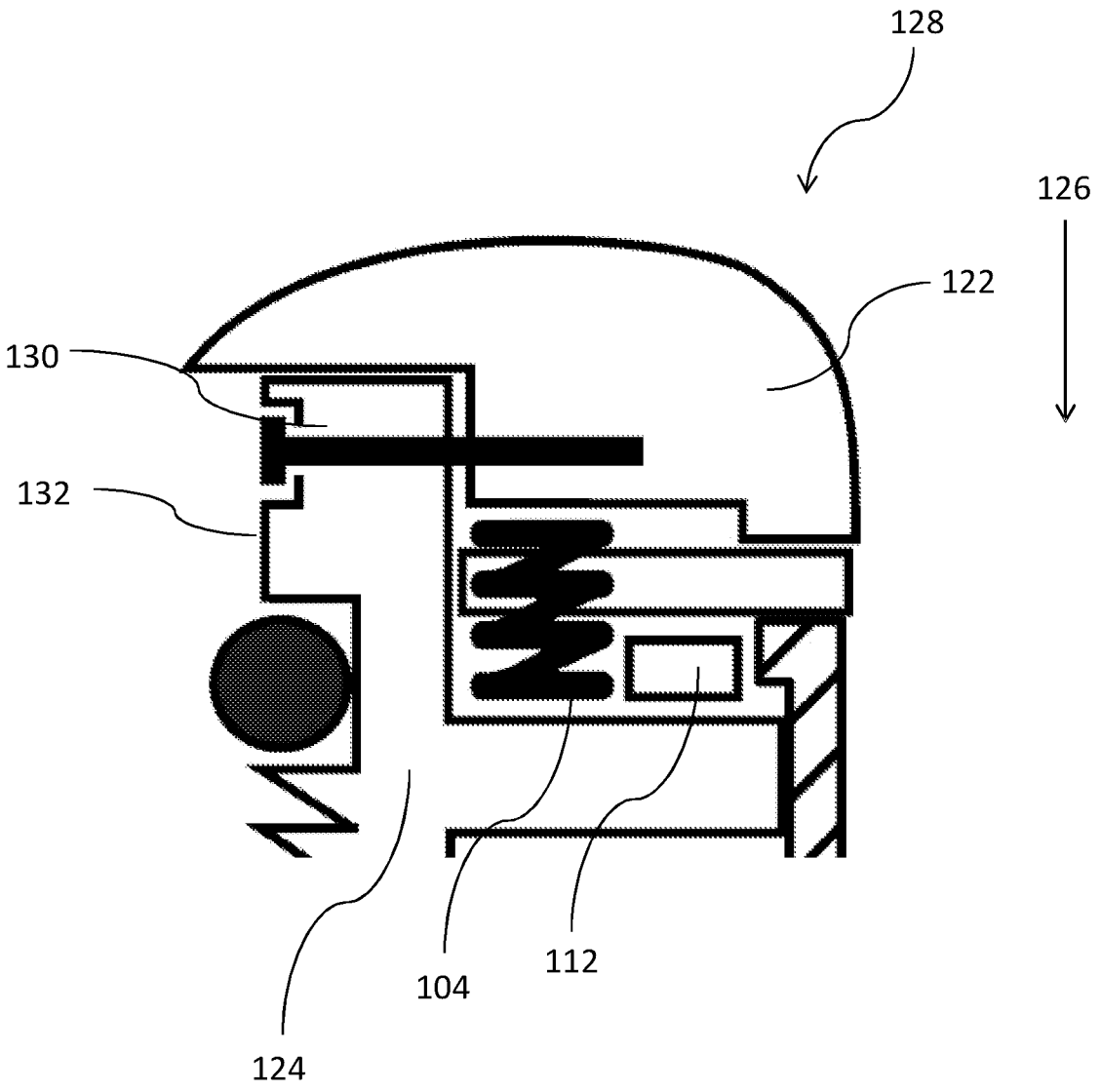
FIG. 4 is an enlarged partial cross-sectional view of a mouth of cooling apparatus in accordance with another embodiment of the present invention.

An alternative option for connecting a bezel 122 and frame 124 is shown in FIG. 4, which shows a longitudinal section of part of the mouth 126 of apparatus 128 according to another embodiment of the invention. In this embodiment, the bezel 122 is connected to the frame 124 by a plurality of inwardly-facing screws 130 that extend from the frame 124 through into the bezel 122. The screws 130 sit flush with the outer surface 132 of the frame 124. This method provides an alternative to threading the frame 124 and bezel 122, and results in simple, cheap manufacture of the apparatus 128. Inserting the screws 130 horizontally as shown does not interfere with any other components—in particular, no shadows of the screws 130 will be cast by the LEDs 112—and still allows the compression required by the springs 104 and capacitive contacts (not shown).

Returning to FIG. 2, the bezel lip 96 of the bezel 14 is generally wider than the hole in a panel through which the apparatus 10 is inserted. The apparatus 10 can therefore be suspended from the bezel lip 96 on the material of the panel surrounding the hole made for the apparatus 10. In use, the bezel lip 96 bears the weight of the apparatus 10 and bottle combined. A frictional or sealing element (not shown) may be incorporated into the bezel lip 96 to aid in sealing the apparatus 10 from moisture ingress and/or slippage during use. In alternative embodiments, the bezel lip 96, and the bezel 14, may have a plan shape other than circular.

Beneficially, the bezel 14 is resistant to scratching or wear during use, and has a lower thermal conductivity than that of the cooling vessel 30 in order to improve the efficiency and reliability of the apparatus 10. For example, it is envisaged that stainless steel with SAE grades 316 or 440, or other high-carbon hardened steels will be used for the bezel 14.

Alternatively, an electrically conductive coating may be applied to the external surface 94 of the bezel 14 and connected through the bezel 14 to another coating that is in contact with the plurality of springs 104.

In addition, further treatments may be applied to the bezel 14 to enhance the properties noted above. Condensation and ice build-up may be reduced near at the mouth 42 of the apparatus 10 by coating the bezel 14 with a hydrophobic coating. To create a harder, more scratch resistant outer coating, the bezel 14 may be treated using Physical Vapour Deposition (PVD).

An insulating sleeve or cup 140 surrounds the cooling vessel 30 and the cooling device 54, and insulates the cooling vessel 30 thermally. The insulating cup 140 comprises a tubular portion 142 and an annular flange portion 144. The lower edge of the tubular portion 142 joins the annular portion 144 such that the outer surfaces of the tubular portion 142 and the annular portion 144 are aligned. The internal diameter of the tubular portion 142 is slightly greater than the outer diameter of the chamber wall 36 of the cooling vessel 30, while the thickness of the tubular portion 142 is similar to the width of the shelf 76. The internal diameter of the annular portion 144 is slightly greater than the diameter of the central portion 46 of the base portion 38 of the cooling vessel 30. The thickness of the annular portion 144 is slightly less than the distance 146 between the flange 48 of the base portion 38 and the main body 64 of the heat sink 60.

The insulating cup 140 preferably manufactured as a single piece as shown for simplicity and to avoid thermal bridging. The insulating cup 140 increases the efficiency of the cooling system 32 by creating as little uninsulated space around the cooling device 54 as possible and also insulates the cooling vessel 30 from the heat sink 60 that become hot in operation. A plurality of cable channels (not shown) are incorporated into the insulating cup 140 through which cables for connecting components at either end of the vessel 30 can be passed. Incorporating circuitry into the insulating cup 140 protects the circuitry from the low temperatures of the cooling vessel 30 and from any moisture that may build up.

The housing 18 is connected to the frame 16 to define the generally cylindrical external surface of the apparatus 10 as can be seen in FIG. 1. The housing 18 is manufactured from a robust material such as steel and protects the internal components from potentially damaging impacts. For example, when installed in a table, the apparatus 10 may be accidentally kicked or knocked by those using it.

The housing 18 incorporates lower perforations or apertures 148 on its bottom face 150 and side apertures 24 around the sides 152 of the housing 18 in the region of the heat sink 60. The apertures 24, 148 are typically hexagonal as shown in FIG. 1, forming a honeycomb structure that makes efficient use of the material and forms the strongest, yet largest area for air flow and heat exchange.

The cooling fan 62 is disposed directly beneath the heat sink 60 and supported by the housing 18 to improve cooling by increasing air flow across the heat sink 60. In the embodiment shown in FIG. 2, the cooling fan 62 is an axial fan that, in use, causes air to be drawn in through the side apertures 24 and expelled through the lower apertures 148. Drawing and expelling air through the housing 18 all aids in keeping the housing 18 cool. Alternatively, in use, the cooling fan 62 may cause air to be drawn in through the lower apertures 148 and to be expelled through the side apertures 24.

It would be possible to support the cooling fan 62 using the heat sink 60. However, by supporting the fan 62 from the housing 18 instead, assembly, manufacture and maintenance are cheaper and simpler.

In some embodiments of the invention, where the apparatus 10 is enclosed and the air flow requires management, a duct system (not shown) is attached to the housing 18 by the use of readily-available ducting adapters and ducts. For example, the cylindrical, circular-section housing 18 lends itself to a circular-section duct (not shown) being attached to the bottom end 150 of the housing 18 to communicate with the lower apertures 148. The duct can be used to introduce cooling air or to exhaust warm air, depending upon the direction in which airflow is drive by the fan 62.

Figure 5:
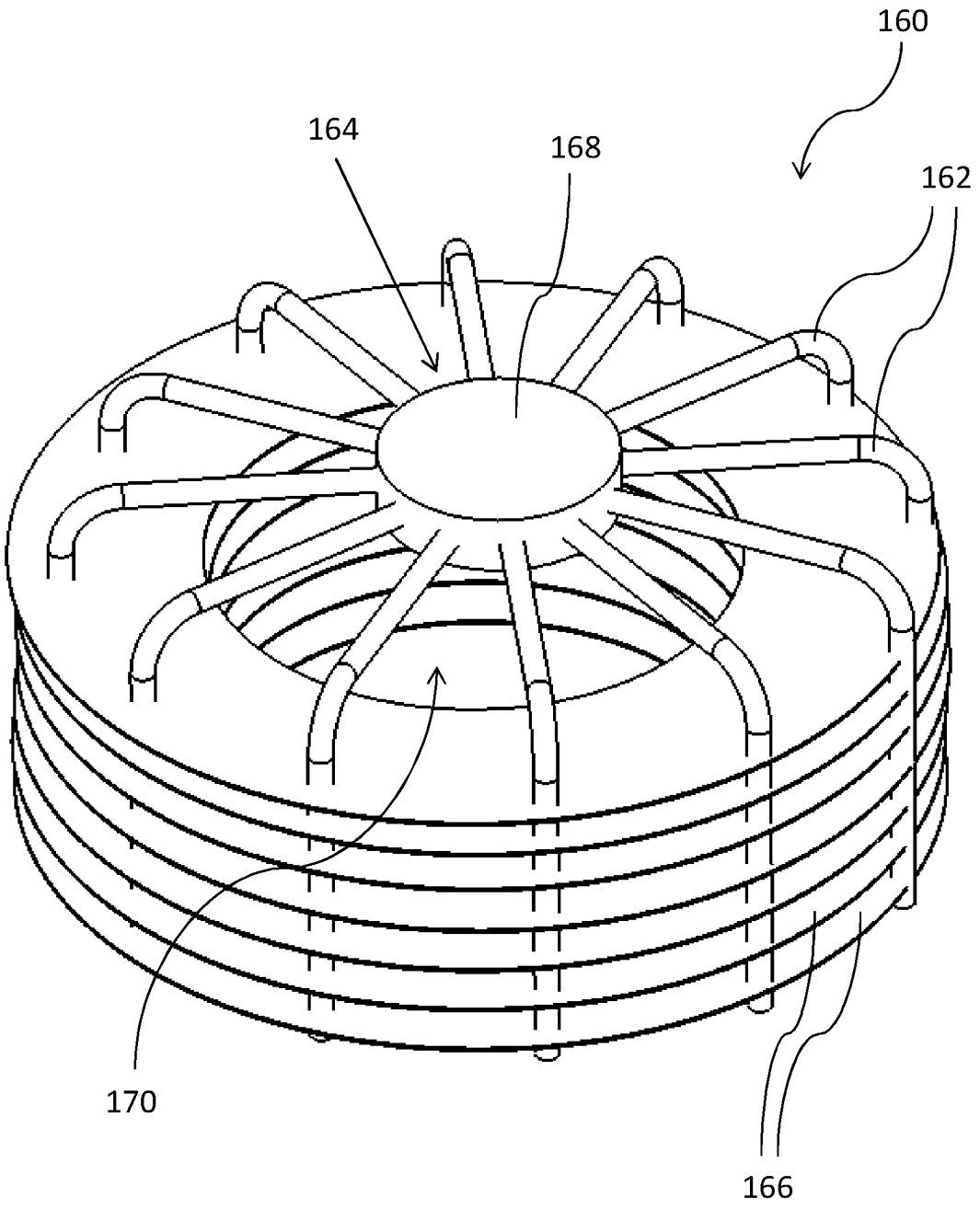
FIG. 5 is a perspective view of a heat sink that may be incorporated into the apparatus of FIG. 1 according to a further embodiment of the present invention.

FIG. 5 shows an alternative heat sink 160. This design incorporates a plurality of heat pipes 162, a central heat transfer chamber 164 and a plurality of stacked horizontal annular fins 166. When installed, the cooling device 54 of the cooling system 32 may abut the top surface, or heat transfer plate 168, of the transfer chamber 164.

The fins 166 are arranged on the heat pipes 162 so as to be equally spaced from one another using a plurality of wedges or spacers (not shown) and are aligned to form a central cylindrical void 170. A centrifugal fan (not shown) may be positioned in the central void 170 surrounded by the fins 166. The centrifugal fan may replace the axial fan 62 or both may be used together to enhance cooling potential.

The central heat transfer chamber 164 is a small cylindrical chamber containing a cooling liquid. The chamber 164 is positioned above the central void 170 and is of similar diameter to the cooling device 54.

The heat pipes 162 connect to the central heat transfer chamber 164 and are equally spaced around the circumference of the heat transfer chamber 164. The pipes 162 extend horizontally away from the central chamber 164 a short distance and turn through a right angle to pass through the fins 166 vertically. The ends of the heat pipes 162 are closed such that there is no flow of cooling liquid within the system. Rather, heat transfer is achieved by convection within the cooling liquid. The pipes 162 and fins 166 are in thermal contact allowing heat to be easily transferred between them.

In use, heat is transferred from the hot side 56 of the cooling device 54 to the transfer chamber 164 and to the liquid contained within it via the heat transfer plate 168 of the transfer chamber 164. The heat is distributed evenly amongst the fins 166, whose large surface to volume ratio improves heat dissipation. The centrifugal fan draws air in below and expels it radially, providing an air flow horizontally to cool the heat sink 160, although this direction of airflow could be reversed.

Figure 6:
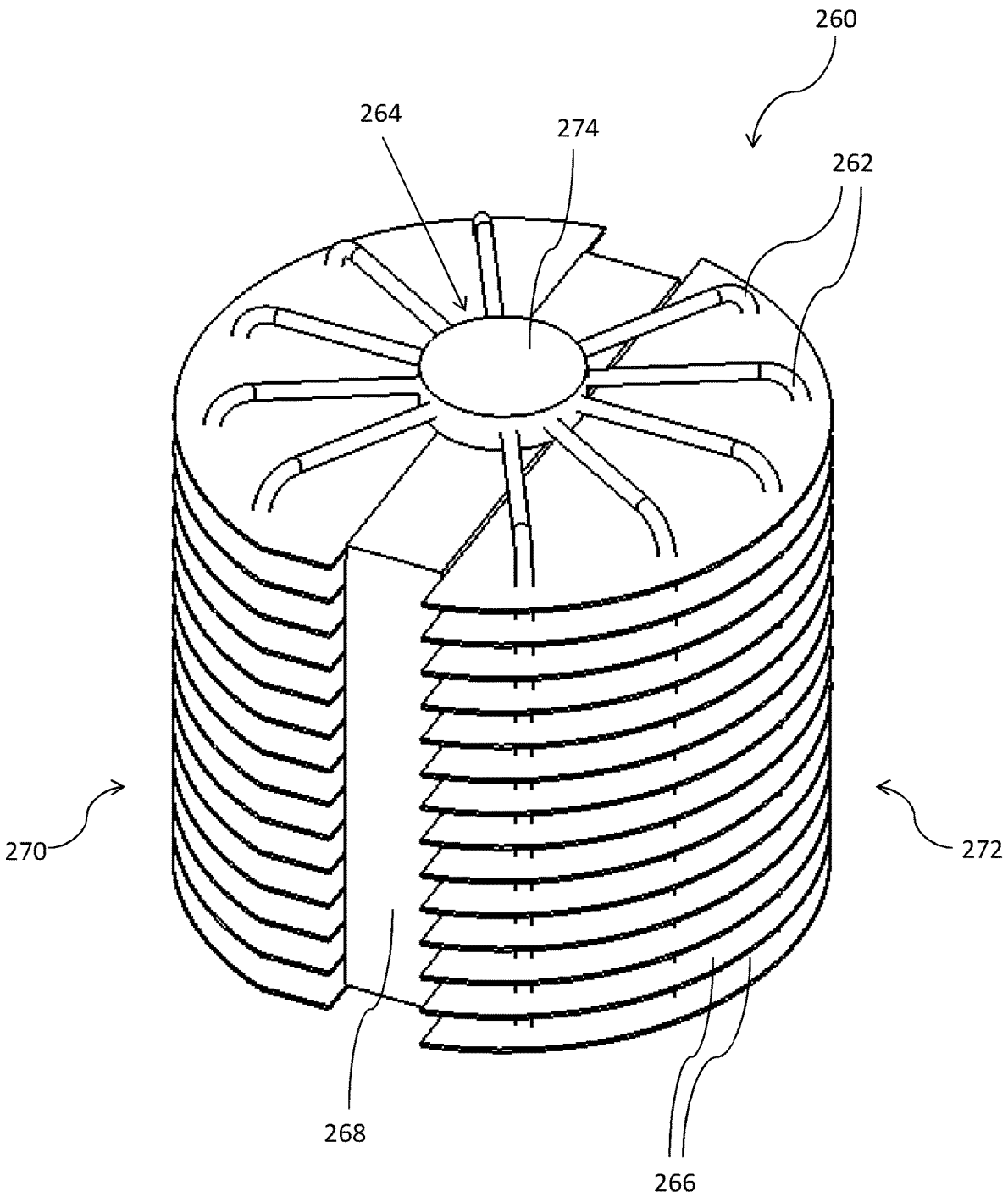
FIG. 6 is a perspective view of another heat sink that may be incorporated into the apparatus of FIG. 1 according to a further embodiment of the present invention.

Another alternative heat sink 260 is shown in FIG. 6, including a plurality of heat pipes 262, a central heat transfer chamber 264, a plurality of horizontal fins 266 and an axial fan 268.

The plurality of horizontal fins 266 comprises two sets of approximately semi-circular fins 270, 272 that are arranged to lie horizontally in respective stacks and are equally spaced vertically by wedges or spacers (not shown). The axial fan 268 is inserted between the two sets of fins 270, 272. When installed, the cooling device 54 of the cooling system 32 is in thermal contact with the top surface, or heat transfer plate 274, of the transfer chamber 264.

The central heat transfer chamber 264 is a small cylindrical chamber containing a cooling liquid. The chamber is positioned above the fins 266 and the axial fan 268 and is of similar diameter to the cooling device 54.

Again, the heat pipes 262 connect to the central heat transfer chamber 264 and are equally spaced around the circumference of the heat transfer chamber 264. The pipes 262 extend horizontally away from the transfer chamber 264 a short distance and turn through a right angle to pass through the fins 266 vertically. The ends of the heat pipes 262 are closed such that there is no flow of cooling liquid within the system. Rather, heat transfer is achieved by convection within the cooling liquid. The pipes 262 and fins 266 are in thermal contact, allowing heat to be easily transferred between them.

In use, heat is transferred from the hot side 56 of the cooling device 54 to the transfer chamber 264 and to the liquid contained within it via the heat transfer plate 274 of the transfer chamber 264. The heat is distributed evenly amongst the fins 266, whose large surface to volume ratio improves heat dissipation. The axial fan 268 draws air in from one side across the fins 266 and expels it at its opposite side, providing an air flow horizontally to cool the heat sink 260.

Figure 7A:
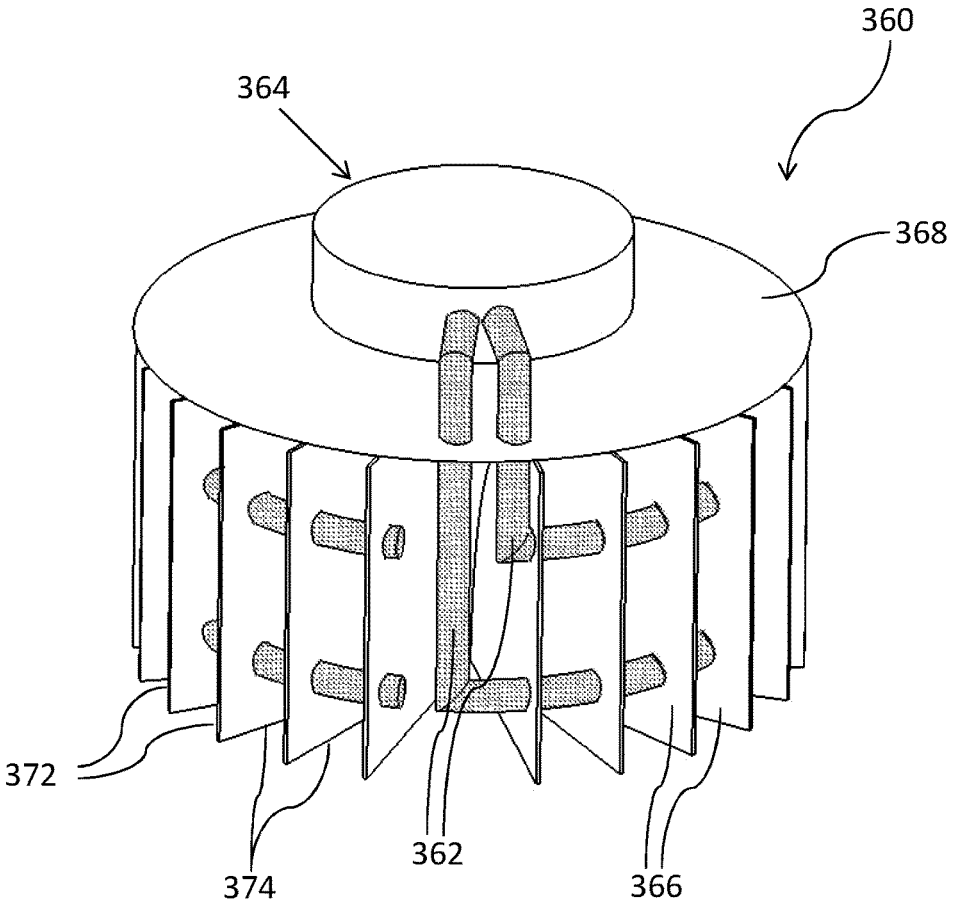
FIGS. 7*a* and 7*b* are, respectively, perspective and cross-sectional side views of a heat sink that may be incorporated into the apparatus of FIG. 1 according to a further embodiment of the present invention.
Figure 7B:
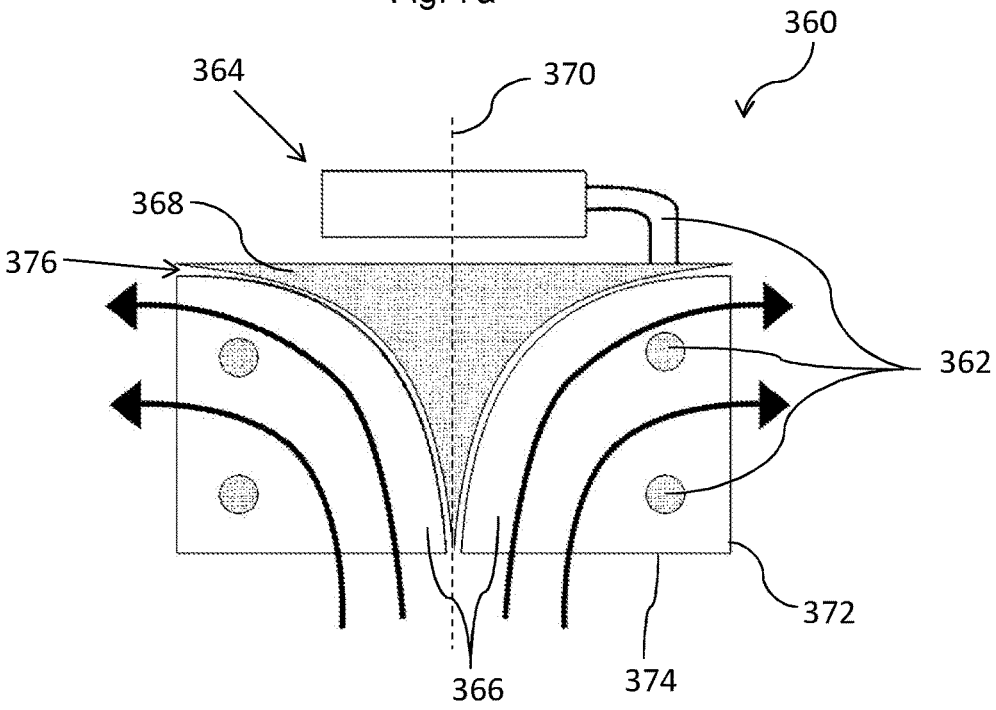

The alternative heat sink 360 of FIGS. 7*a* and 7*b* comprises a plurality of heat pipes 362, a central heat transfer chamber 364, a plurality of fins 366 and a block 368. The block 368 is shaped to fit between a plurality of quarter-circle fins 366 that are angularly spaced equally in respective vertical planes in a circular arrangement about a central vertical axis 370, such that that their flat edges 372, 374 face outwards and downwards. The resulting void 376 forms a point with rounded edges and the block 368 is shaped to fill as much as this void 376 as possible and optionally to be in thermal contact with the fins 366. Thus, the block 368 has a rotationally symmetrical, downwardly tapering shape whose longitudinal section has curved sides with mutually-asymptotic curvature.

The heat pipes 362 connect to the central transfer chamber 364 and extend substantially parallel to each other. The pipes 362 follow a path horizontally out of the chamber towards the edge of the block 368 before a right angle turn to the vertical. Their path continues vertically down through the outer edge portion of the block 368 until the pipes 362 are vertically spaced between the fins 366. The pipes 362 then extend horizontally and circumferentially through every fin 366.

In this embodiment of the heat sink 360, heat transfers between the hot side 56 of the cooling device 54 and the liquid within the central heat transfer chamber 364 and the pipes 362. The liquid transfers heat to the fins 366 via the pipes 368. The shape of the fins 366 and the central block 368 aids in the drawing air through the side apertures 24, and down through the axial fan 62 or vice versa as shown in FIG. 7*b*.

Figure 8:
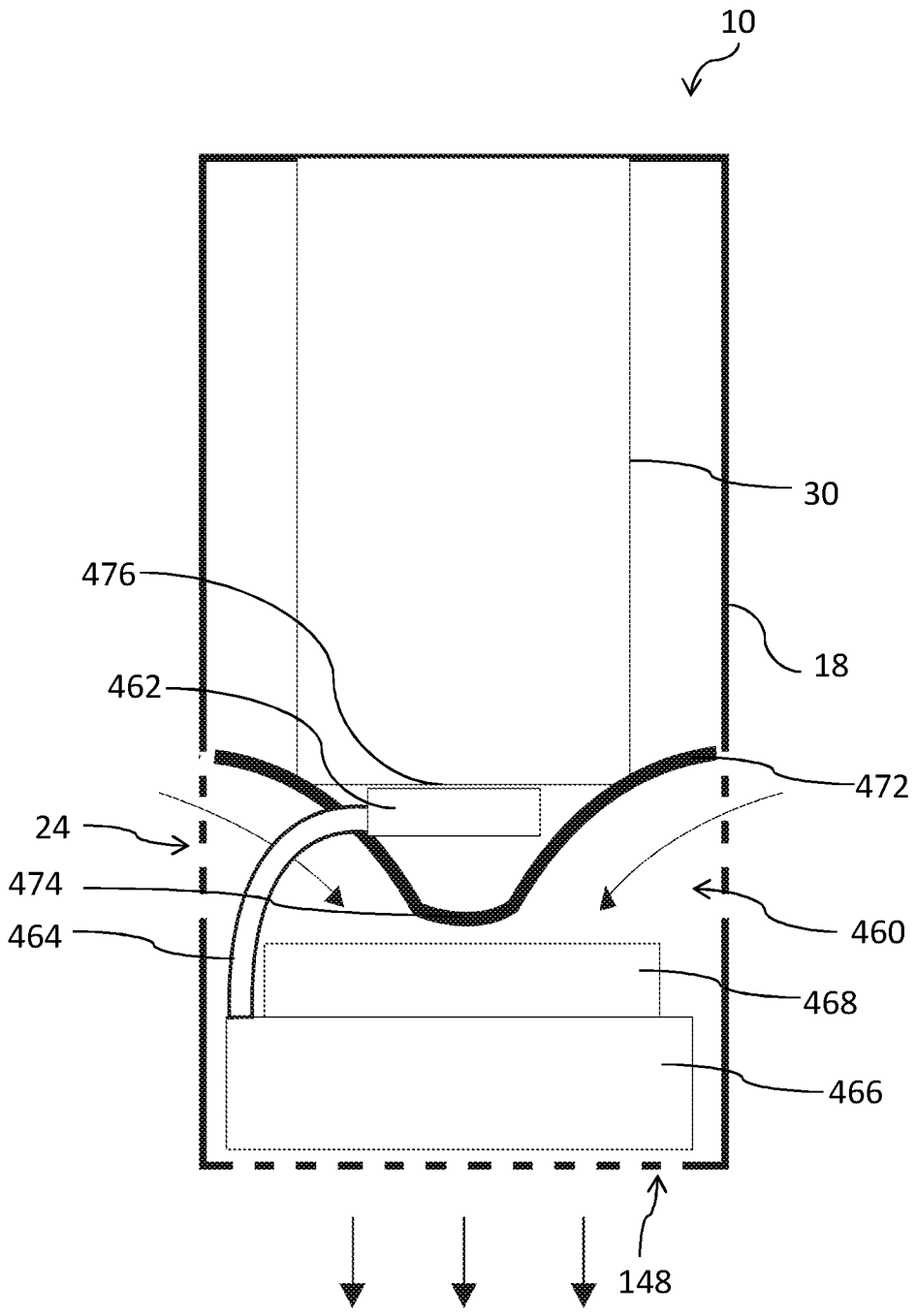
FIG. 8 is a schematic longitudinal sectional view of the apparatus of FIG. 1 incorporating a water cooling system according to another embodiment of the present invention.

FIG. 8 shows a water-cooled system 460 that comprises a heat transfer chamber 462, at least two pipes (only one of which, 464, can be seen in FIG. 8) that connects the transfer chamber 462 to a radiator 466, an axial fan 468 above the radiator 466, and a generally conical air flow guide 472 that tapers downwardly from above the side apertures 24 of the housing 18 to a rounded central point 474 adjacent the fan 468.

The cooling device (not shown in this diagram) abuts an upper surface 476 of the heat transfer chamber 462, transferring heat to the water within the chamber 462. The water within the chamber 462 is circulated through the system by a pump (not shown) within the chamber 462. For example, the flow path of the water may be from the chamber 462 to a first pipe 464, to the radiator 470, to a second pipe (not shown), and from there back to the chamber 462.

The radiator 470 and fan 468 are suitably supported by the housing 18 of the apparatus 10, and heat is dissipated through the radiator 470. A constant air flow is maintained by the axial fan 468 that encourages the flow in a downwards direction.

The air flow guide 472 directs air drawn in by the fan from the side apertures 24 in the housing 18 to initiate a substantially right-angle change in direction from a horizontal air flow to a vertical air flow such that the air can flow through the fan 468 and past the radiator 470. This aids in the dissipation of heat from the lower apertures 148 of the apparatus 10.

The air flow guide 472 is constructed from a thermally-insulating thermoplastic such that little to no heat is transferred from any components to it. The air flow guide 472 further aids in component separation, ensuring there is minimal heat transfer between hot and cold components. The air flow guide 472 is conveniently suspended from the housing 18, but may be suspended from the transfer chamber 462.

In use, the heat sinks detailed in relation to FIGS. 5 to 8 are fixed to the vessel 30 using screws (not shown) that extend through the vessel 30 and into the heat sinks.

This allows the heat sinks to be suspended from the vessel 30 without compromising the heat dissipating properties of each heat sink.

Figure 9:
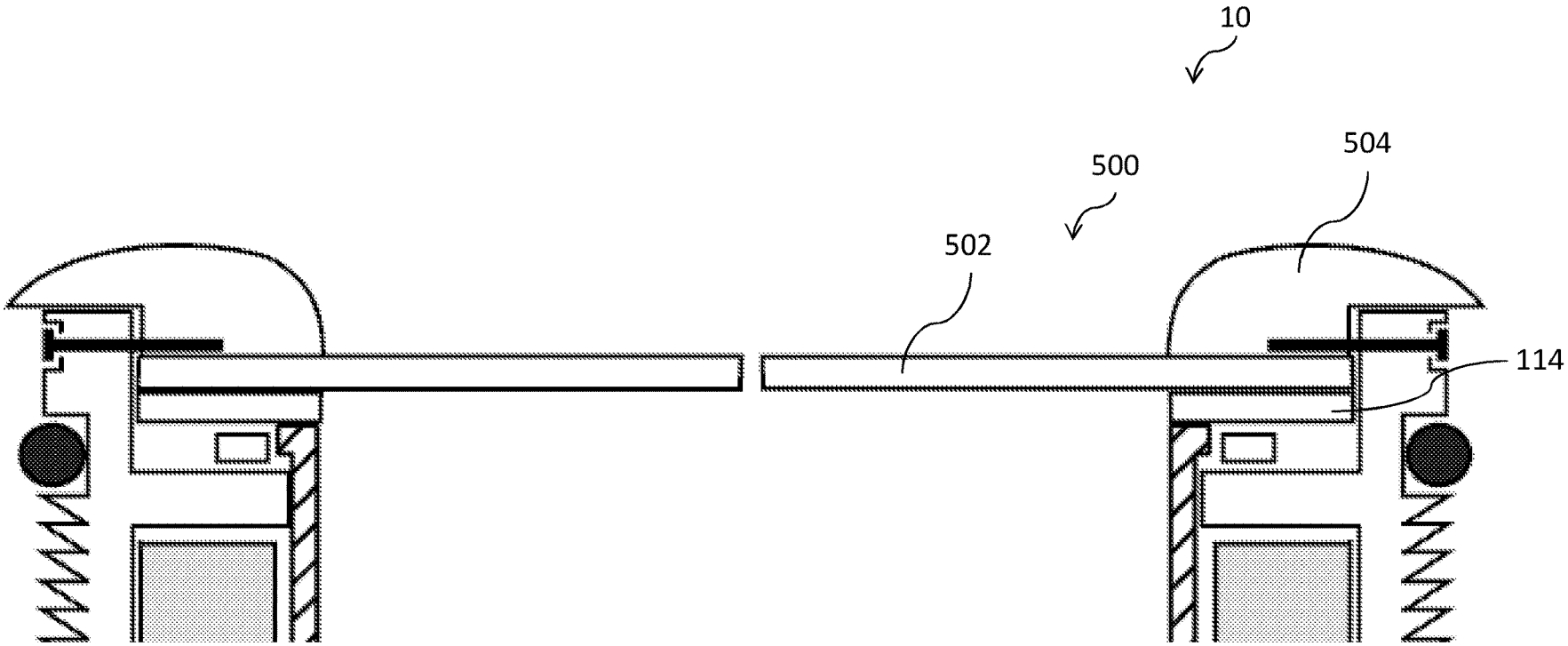
FIG. 9 is an enlarged cross-sectional view of the mouth of cooling apparatus that comprises a bottle seal according to an embodiment of the present invention.

Referring now to FIG. 9, this shows a bottle seal 500 that may be incorporated to enhance cooling performance. The bottle seal 500 takes the form of a rubber gasket 502 or other flexible seal. In this example, the gasket 502 is clamped between a modified bezel 504 (modified in that it lacks the inner skirt 100 of the original bezel 14) and the optical element 114 of the apparatus 10. The flexibility of the seal material means that a bottle (not shown) can be easily inserted into the apparatus 10 through the gasket 502, which flexes out of the way and then bears against the side of the bottle, but creates a barrier to heat from the external environment, thereby improving the cooling performance of the apparatus 10. This is advantageous in situations where the external environment may be particularly hot, or where the apparatus 10 may be running for a long time and energy costs need to be reduced.

Figure 10A:
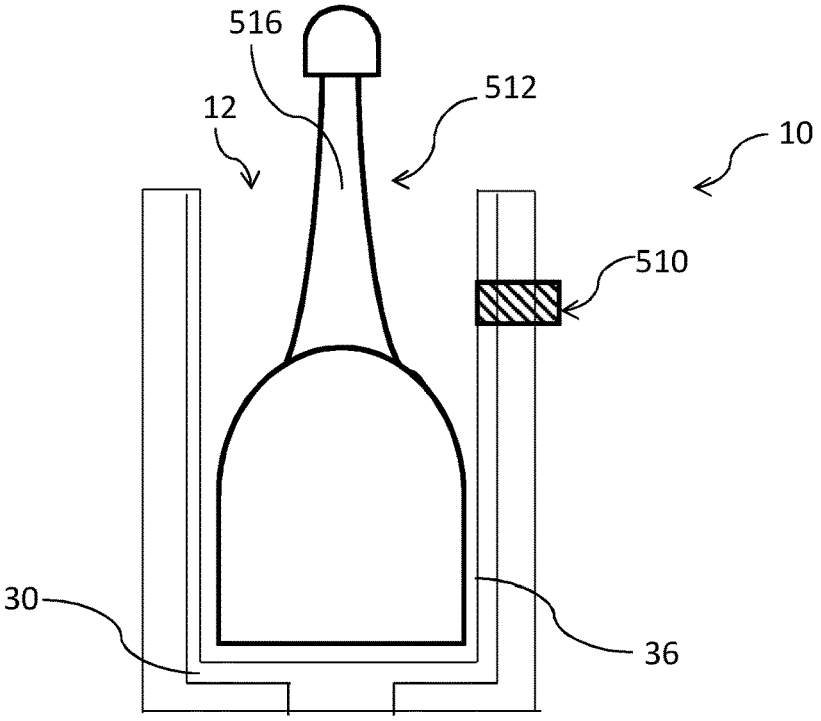
FIGS. 10*a* and 10*b* are schematic longitudinal sectional views of a chamber of cooling apparatus that comprises a bottle lock according to another embodiment of the present invention.
Figure 10B:
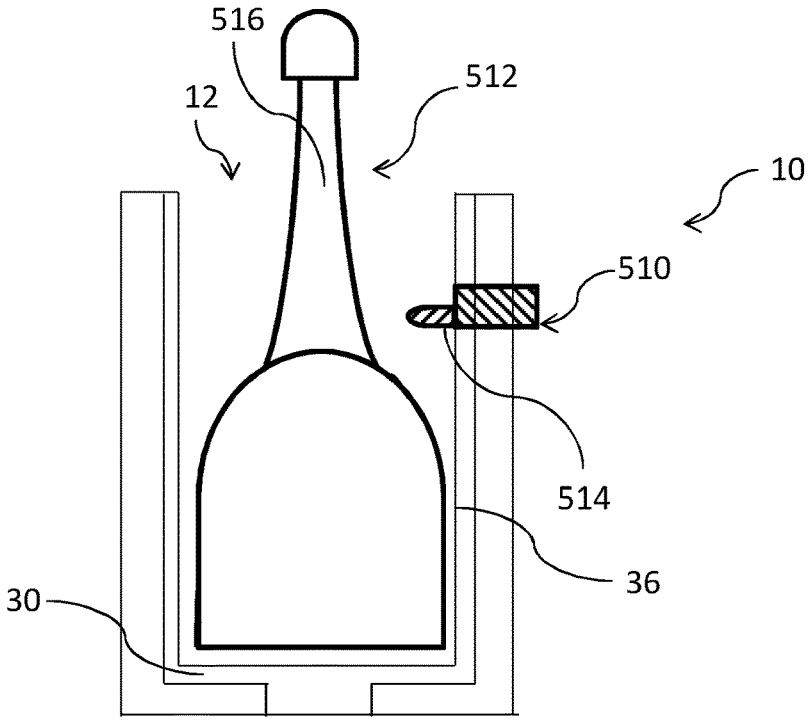

In a further option, a bottle lock system 510, as shown in operation in FIGS. 10*a* and 10*b*, may be incorporated into the apparatus 10 to secure a bottle 512. In this example, the bottle lock system 510 comprises at least one solenoid bolt 514 that extends a short distance through the chamber wall 36. When required, the bolt 514 extends radially inwards towards the centre of the chamber 12 and is locked in place in a deployed position. This is shown in the movement from FIG. 10*a*, where the bottle 512 is free to be removed from the vessel 30, to FIG. 10*b*, where the bolt 514 has extended through the chamber wall 36 into the bottle chamber 12 such that it restricts the effective diameter of the vessel 30. The distance that the bolt 514 extends into the bottle chamber 12 is calculated so as not to strike the inserted bottle 512 whose upper portion 516 typically tapers upwardly as shown, but to be extended far enough that the bottle 512 cannot be removed. The bottle lock system 510 may be controlled by an authorised user, using a remote control, a Bluetooth device or a smart touch mechanism. These features will be discussed later.

Referring mainly to FIG. 2, in use, the core purpose of the apparatus 10 is to cool, or at least to maintain an already cold temperature of, a bottle inserted into the chamber 12. To achieve this, the vessel 30 is cooled by the cold side 58 of the cooling device 54, while heat is dissipated by the heat dissipation system 34 from the hot side 56 of the cooling device 54.

The cooling device 54 cools the vessel 30 to a set temperature. This set temperature is calculated so that champagne or other beverage within a bottle that is inserted into the vessel 30 is maintained at the correct temperature. The vessel 30 and heat sink 60 are dimensioned to allow cooling towards a set temperature only, and the power input requirements of the cooling device 54 and the fan 62 are chosen so that the cooling capability of the apparatus 10 is optimal for the temperature required only. Therefore, the components used in combination are preferably designed to allow cooling towards a single temperature only.

Temperature regulation may be achieved by incorporation of a discreet thermostat (not shown) incorporated into the vessel 30 and controlled by the CPU (not shown).

At the beginning of the cooling process, the fan 62 and cooling device 54 may be run at a higher level than is usual, allowing a quicker drop-down from the ambient temperature to the required temperature. At the end of a cycle, if ice or water has accumulated in the bottom of the vessel 30, it is possible to switch the polarity of the cooling device 54, by using a polarity switch (not shown), to allow heating of the vessel 30 to evaporate water and/or to melt ice that may have collected.

Figure 11:
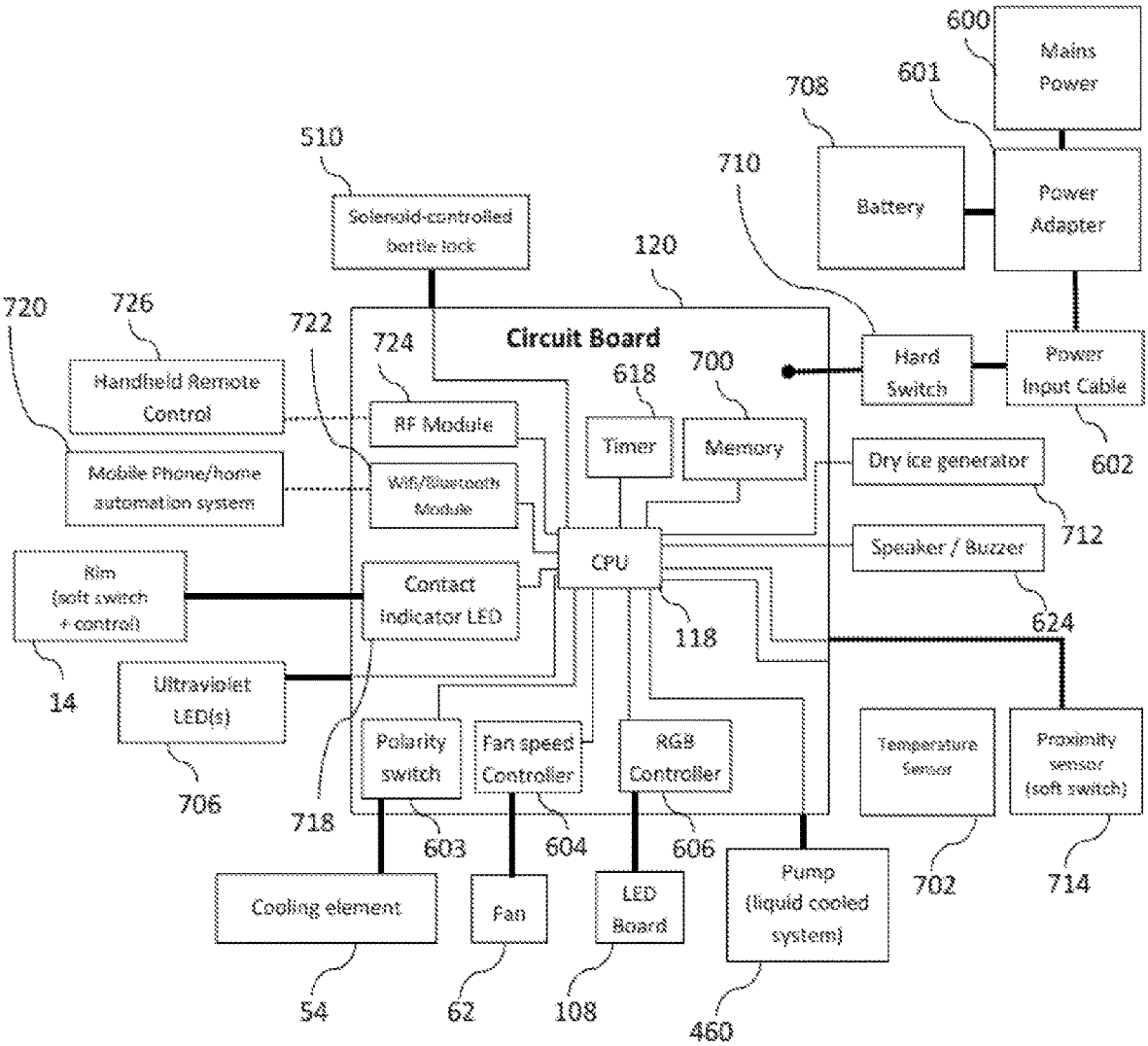
FIG. 11 is a diagram of hardware that may be used to control and operate apparatus of the type shown in FIG. 1.

FIG. 11 outlines hardware that may be used within the apparatus 10. Control and operation of the apparatus 10 is processed by the CPU 118, which connects to all electrical systems of the apparatus 10. It will be appreciated that the modules illustrated may be used in many different combinations to achieve the operations described below and that other relevant modules may be incorporated without departing from the scope of the invention. Similarly, some modules could be omitted if their functionality is not required.

Additionally, FIGS. 12*a* to 12*d* are flow diagrams detailing the potential operation of the apparatus 10 under differing circumstances. The operation of the apparatus 10 and optional features that may be incorporated into the apparatus 10 will now be described with reference to FIGS. 11 to 12*d*.

The simplest mode of operation of the apparatus 10 is the on/off mode. In the on/off mode, mains electrical power 600 supplied to the apparatus 10 is routed through a power adapter 601 and an input cable 602 to the circuit board 120. The CPU 118 detects a power input, and activates the apparatus 10. Activation of the apparatus 10 comprises switching the cooling device 54 to cool the vessel 30 using a polarity switch 603, activating the fan 62 using a fan speed controller 604, and optionally activating the LED board 108 by a colour (RGB) controller 606. This process will be referred to from now on as activation of the apparatus or the apparatus being activated. In this simplest mode of operation, the apparatus 10 operates constantly when power is supplied to it.

Figure 12A:
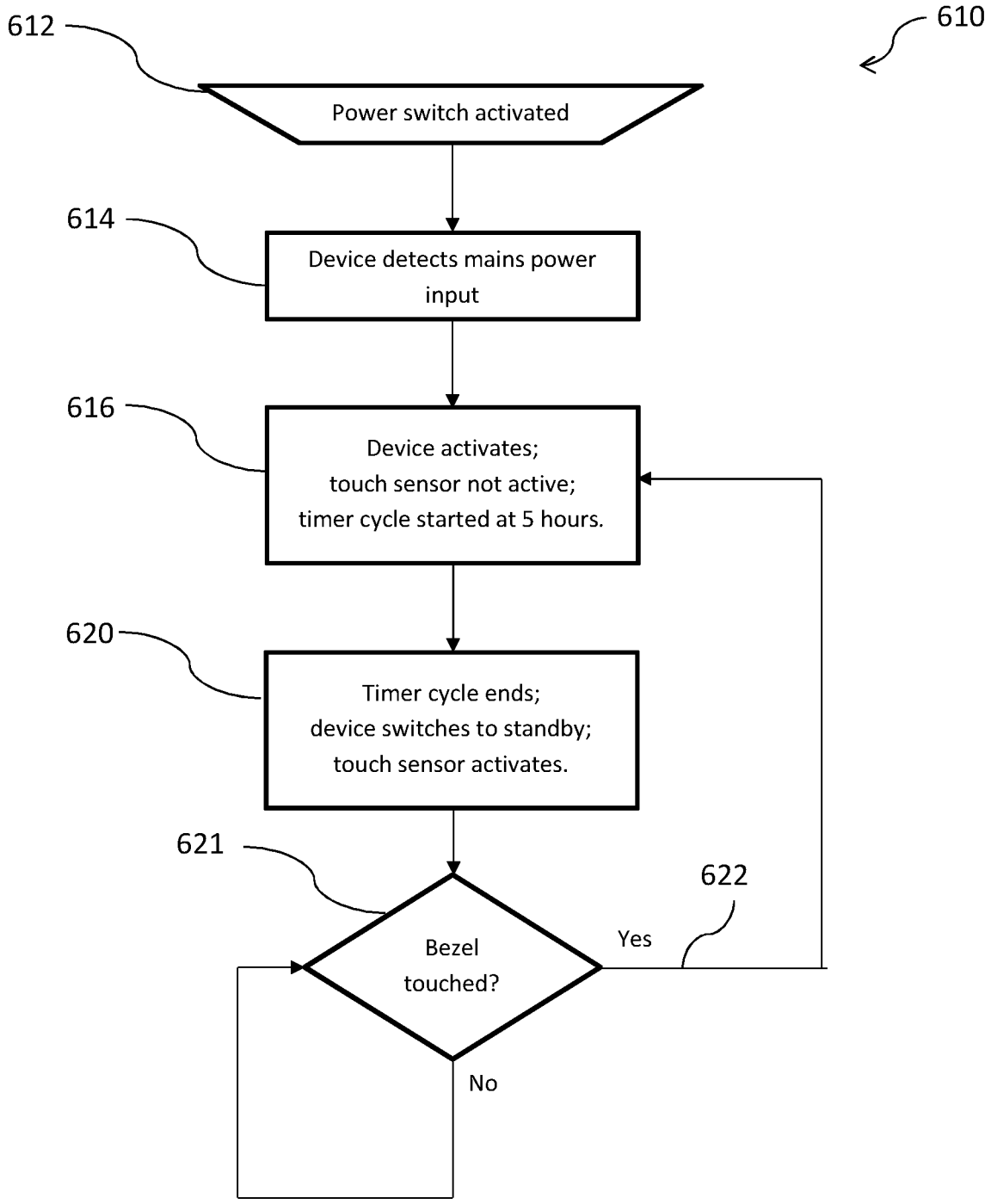
FIGS. 12*a* to 12*d* are flow diagrams of operating modes that may be implemented in a device of the invention.

An alternative mode implemented by the CPU 118, which will be referred to as single cycle mode, is shown in FIG. 12*a*. Single cycle mode makes use of the touch capabilities that are achieved by the capacitive contact that connects to the bezel 14. In the single cycle mode process 610, a mains power input is supplied 612 to the circuit board 120 and detected 614 by the CPU 118. In the next step in the single cycle mode process 610, the CPU 118 activates 616 the apparatus 10. A timer module 618 on the circuit board 120 is activated and a cycle begins 616 for a set suitably predetermined amount of time, for example, 5 hours. During this cycle, any touch input to the bezel 14 causes no alteration of the operation of the apparatus 10 by the CPU 118. At the end of the 5 hour cycle, the timer 618 is deactivated and the CPU 118 switches 620 the apparatus 10 to a standby setting. During the standby setting, inputs to the bezel 14 are registered 621 by the CPU 118. If the bezel 14 is touched 622, the process returns to step 616 and the apparatus 10 activates with a reset 5 hour cycle.

In the standby setting, the cooling device 54 and fan 62 are not active. The LED board 108 is dimly lit at a colour chosen to show that standby mode is active. A speaker or buzzer 624 incorporated between the insulating cup 140 and the housing 18 may alert the user that the apparatus 10 is switching to standby.

Figure 12B:
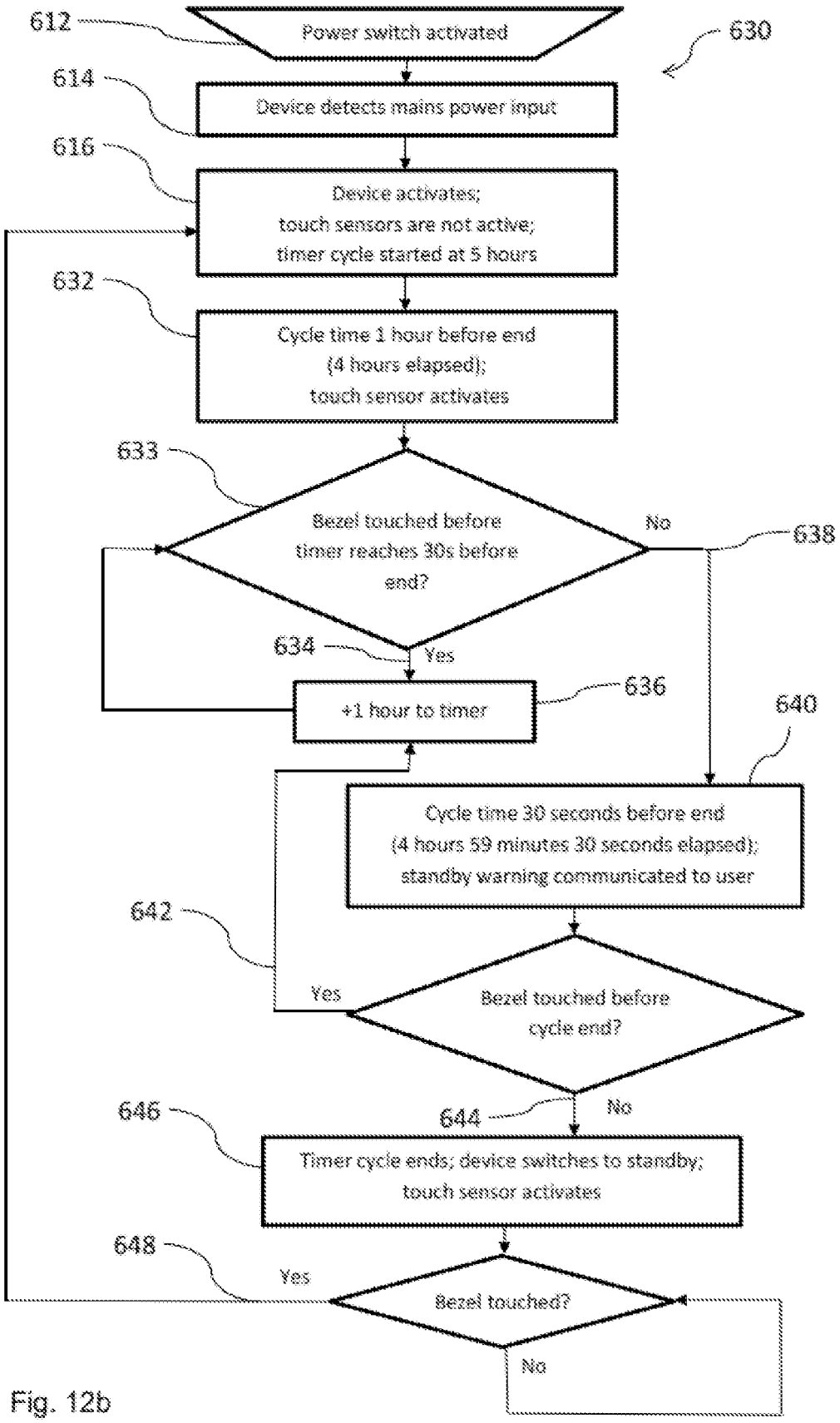

FIG. 12*b* illustrates operation of the apparatus 10 in another mode, referred to from here onwards as 'extra hour mode' although an extra period of more or less than an hour would be possible. The extra hour mode process 630 operates initially as the first three steps of single cycle mode: the CPU 118 detects 614 power input 612 and activates 616 the apparatus 10 accordingly but does not register any touch input during this time. The CPU 118 also activates 616 the timer 618 for a timer cycle set to, say, 5 hours. At the fourth step 632, where 4 hours of the timer cycle have elapsed in this example (i.e. when 1 hour of the time remains), touch inputs to the bezel 14 may be registered 633. If the bezel 14 is touched during this period 634, an extra hour is added 636 to the timer cycle up to a limit. This optional limit prevents accidental touching of the bezel 14 resulting in a large amount of time being added to the timer cycle in error.

If the bezel 14 is not touched 638 in the remaining time, a visual warning, and optionally an audible warning (if a speaker or buzzer 624 has been installed), are issued 640 when, say, 30 seconds of the timer remains (i.e. when 4 hours 59 minutes and 30 seconds have elapsed in this example). If the warning causes the user to press 642 the bezel 14, an extra hour is added 636 to the timer cycle and the process returns to step 633. If the user does not touch 644 the bezel 14 before the end of the cycle, even after the 30 second warning has been given, the timer cycle ends 646, the timer 618 deactivates 646, and the CPU 118 switches 646 the apparatus 10 to standby. If the bezel 14 is touched 648 while the apparatus 10 is in standby, the cycle begins again at step 616, with the timer cycle set to the original set time limit.

Figure 12C:
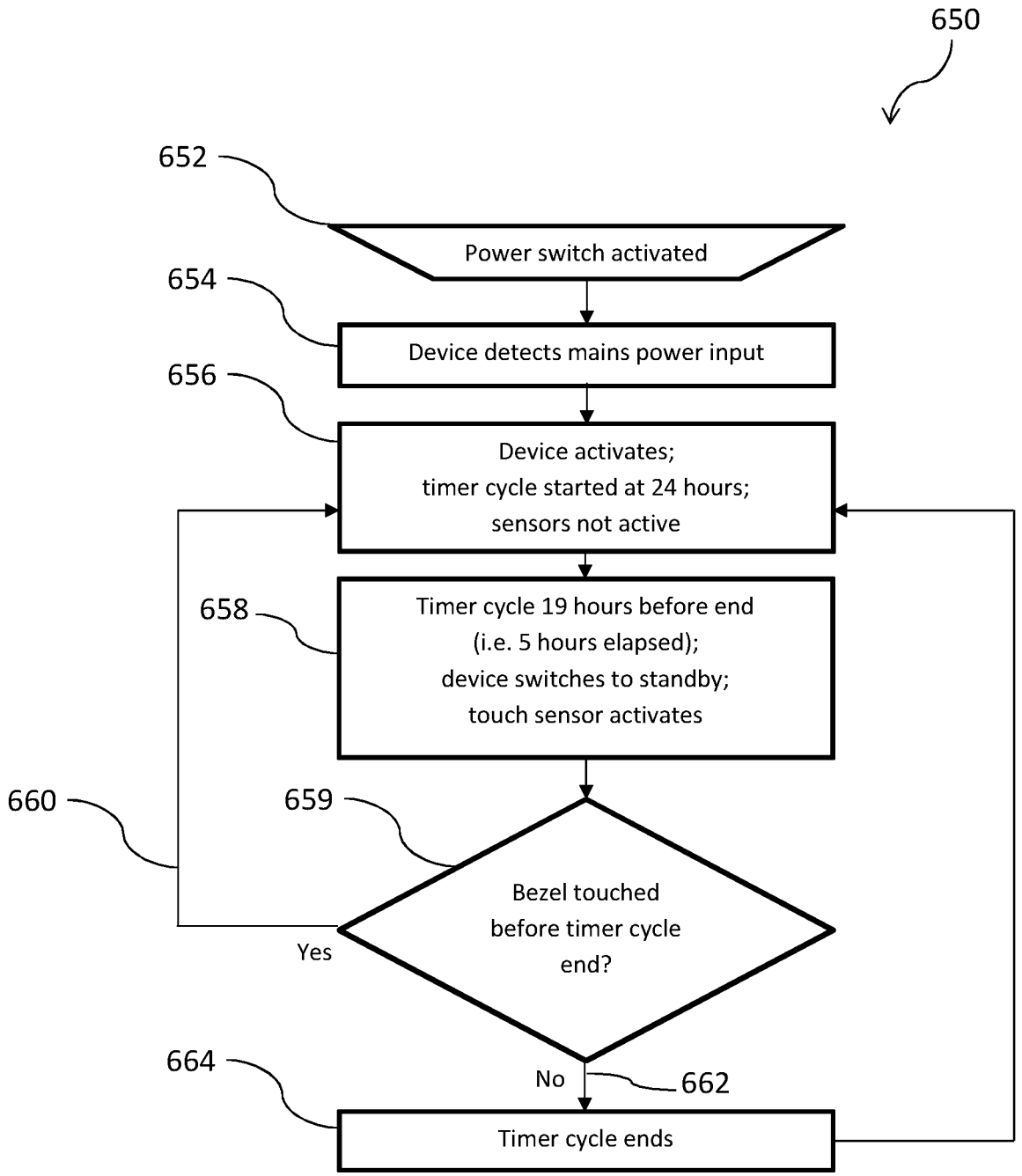

FIG. 12*c* illustrates a 24-hour mode that is used to activate the apparatus 10 at the same time every day and have it to run for a set amount of time. This could be particularly useful in a commercial setting, allowing a venue such as a bar to have apparatuses all of which activate at the opening time of the venue and remain active until closing time, for example. In this setting, a further feature may be used, in which a plurality of apparatus are connected to the same power source. In some cases, the apparatuses may share a centralised control unit to allow one setting to be applied to all apparatuses. Other multi-apparatus set ups may make use of a Wi-Fi or Bluetooth system via an application, or a remote control system as shown in FIG. 11. If a plurality of apparatuses are connected in any of these ways, the settings for one apparatus may be optionally shared with the other apparatus, allowing simple set-up of multiple apparatuses within a large commercial setting.

In the 24-hour mode process 650 in FIG. 12*c*, power is supplied 652 and when it is detected 654 by the CPU 118, the apparatus 10 is activated 656 and the timer 618 started 656 to with a timer cycle set to 24 hours. Initially, touch sensor inputs are not registered 656 by the CPU 118. When a required on-time has elapsed (5 hours is used as an example again here), the apparatus 10 is switched 658 to standby and any touch inputs are registered 659 by the CPU 118. If the bezel 14 is touched 660 during the remaining 19 hours of the cycle, the apparatus 10 activates 656 and the timer cycle is reset 656 to 24 hours. If the bezel 14 is not touched 662 during this time, the 24 hour timer cycle restarts 656 at the end of the cycle 664, ensuring that the apparatus 10 is active for the same 5 hours as it was the previous day.

Alternatively, changes may be made to the 24-hour mode to allow two periods of apparatus activity, or to restrict the touch control of the apparatus 10 such that the core on-time is fixed and extra hours are added when the bezel 14 is touched.

It will be appreciated that while the modes above activate when a power input is detected, it is also possible to alter the operation of the apparatus 10 such that the CPU 118 places the apparatus 10 in the standby setting when a power supply is detected, allowing touch input to dictate when the apparatus 10 is activated. This change is effected in the mode discussed in relation to FIG. 12*d* below.

Figure 12D:
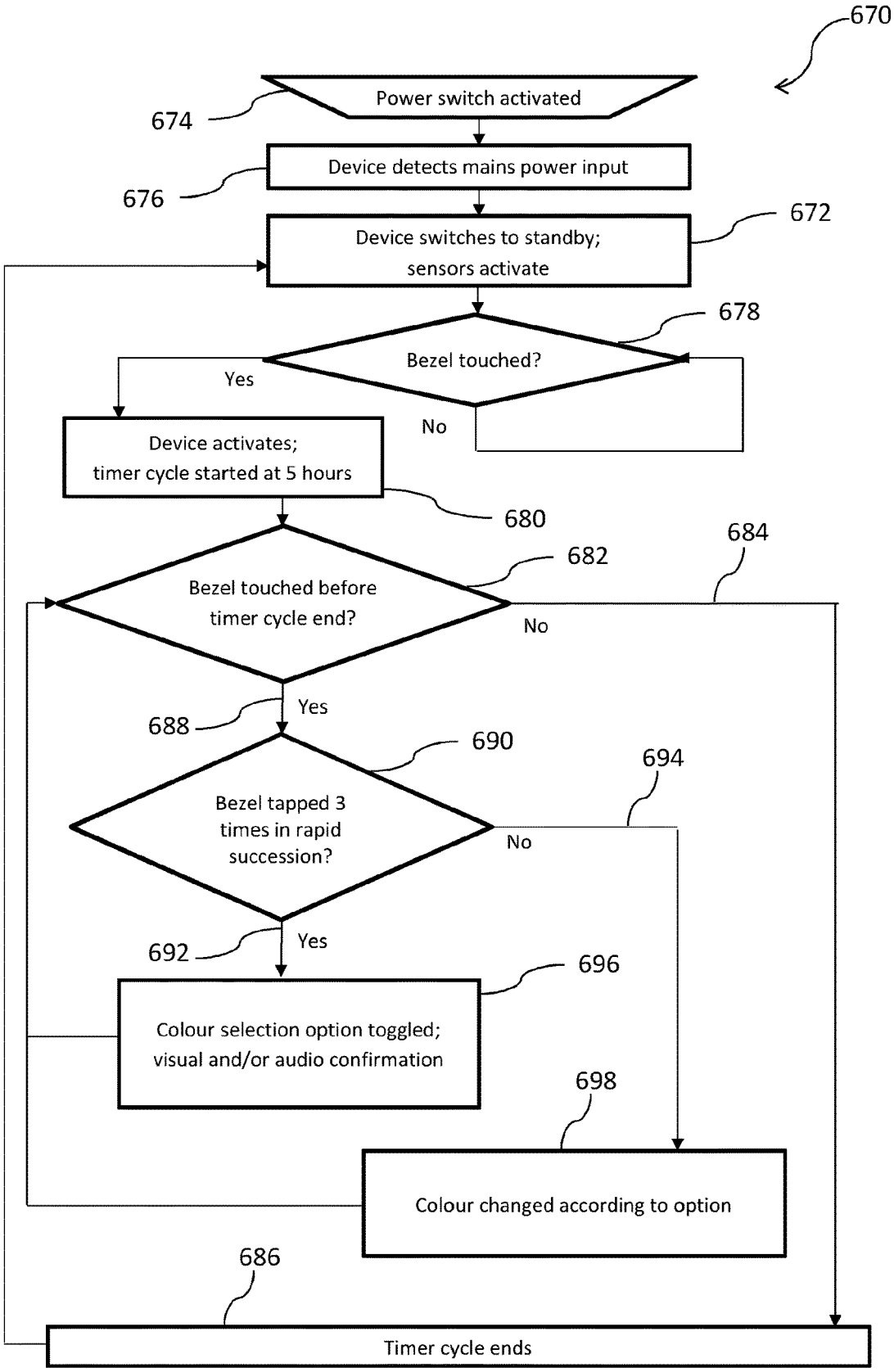

The mode illustrated by FIG. 12*d* is an option selection mode. When the option selection mode process 670 is active, the apparatus 10 is switched 672 to standby by the CPU 118 when a power input is activated 674 and detected 676. Touch inputs may be registered 678 when the apparatus 10 is in standby so that the CPU 118 can activate 680 the apparatus 10 and begin 680 a timer cycle when the bezel 14 is touched. The apparatus 10 is kept in standby until this point.

Touch input may still be made 682 during the cycle and is registered by the CPU 118. If the bezel 14 is not touched 684 while the apparatus 10 is active, the apparatus 10 is operated in single cycle mode, switching 672 to standby when the cycle ends 686 with no touch input to the bezel 14. The CPU 118 continues to register 678 any touch input to the bezel 14 during the standby setting.

During the cycle, if a touch input is detected 688, the CPU 118 responds differently according to the type of input. In the example shown in FIG. 12*d*, the touch inputs are separated 690 according to whether the bezel 14 is tapped multiple times 692 in quick succession (for example, 3 taps within 3 seconds) or not 694. If the bezel 14 is tapped 3 times in quick succession 692, the colour selection option is toggled 696 and a visual and/or audio confirmation is given to the user via the LED board 108 and/or speaker 624 respectively. If the touch input did not contain 3 quick taps 694, the CPU 118 implements the settings of the colour option 698 that is selected.

The illustrated option selection mode is simplistic, and more complicated option selection processes are envisaged in practice. For example, more taps in quick succession may indicate alternative option selections. A possible set-up is shown in the table below.

| Number of taps | Option selected |
|---|---|
| 3 | Dynamic colour toggle |
| 4 | Fixed colour selection |
| 5 | Colour cycle |
| 6 | 24 hour mode switch |
| 7 | Option lock |
| 8 | Standby |

As shown above, a number of different options may be selected. Dynamic colour toggle refers to two options that may be selected to change the colour of the light emitted by the LED board 108 during use. In the first dynamic colour option, the colour slowly cycles through the available colours when the bezel 14 is touched and held, while in the second dynamic colour option, the colour changes to the next set colour when the bezel 14 is touched.

Fixed colour selection allows the user to set the colour by touch selection and save that colour to a memory module 700 of the circuit board 120 by not touching the bezel 14 for a set period of time.

Colour cycle mode cycles the colours of the LED board 108 through all available colours for the remainder of the cycle.

24 hour mode switch restarts the timer to a 24 hour cycle and to run as in 24 hour mode in FIG. 12*c*. Touch inputs are registered in this adapted 24 hour mode switch, and the 24 hour mode can be turned off by selecting this option again.

7 taps in rapid succession corresponds to mode lock in which the CPU 118 does not register or respond to any input to the touch sensors that does not consist of 7 rapid taps on the bezel 14. 7 taps toggles the mode lock and allows the bezel 14 to be used again to control the system.

The highest number of taps is reserved for the standby option, as the user may continue to tap until the apparatus 10 returns to standby. There is no need for the user to remember the number of taps required. Rather, the user just continues to tap rapidly until the apparatus 10 turns to standby.

The above option selections are stored in non-volatile memory 700 of the circuit board 120, allowing each option selection to be retained when the power supply 600 is removed and resupplied.

Further control over modes and options may be implemented by using more complicated modes and inputs to the bezel 14. For example, if a temperature sensor 702 is incorporated, the user may be able to control the temperature to which the vessel 30 is cooled by touch input.

It will be appreciated that many types of touch input are possible using a touch sensor as described. The touch inputs described here are illustrative only, and many different inputs may be used without departing from the scope of the invention.

Optional hardware modules shown in FIG. 11 and incorporated into the system are: a bottle lock 704 (see explanation above in reference to FIG. 10); a backup power supply 706 or main power supply in the form of a battery 708; a switch 710 for providing power to the unit; a dry ice chamber or generator 712; a speaker or buzzer 624 for alerting the user or selecting different modes (see above); a temperature sensor 702; a proximity sensor 714 to allow different operations of the apparatus 10 when no bottle is present within the chamber 12; a liquid cooling system (see above, FIG. 8); at least one ultraviolet LED 716 incorporated into the chamber 12; a contact LED 718 that illuminates when the bezel 14 is touched; a home automation or mobile phone connection 720 using a Bluetooth or Wi-Fi module 722; and a remote control module 724 to control the apparatus 10 via a remote control 726.

A battery 708 may be incorporated to allow the apparatus 10 to be portable or stored in a movable housing for use at events in non-standard venues such as festival sites or similar situations in which installation of the apparatus 10 in a fixed position is not possible. The battery 708 may be paired with a hard switch 710 that enables the user to supply power to the unit at will. A hard switch 710 may also be used in conjunction with the mains power system 600, although for simplicity of design, such a switch 710 is currently considered optional.

A dry ice chamber or generator 712 and at least one ultraviolet LED 716 may be incorporated into the chamber wall 36 and insulating cup 140 to provide the user with visually-appealing effects in addition to the LED board 108.

Further control of the apparatus 10 can be given to the user in the form of a remote control system 724 or connection to a home automation system 720 or application that controls the apparatus 10 over a Wi-Fi or Bluetooth connection via a W-Fi or Bluetooth module 722. Touch control would still be possible, and the functions of the touch may be configured using the remote system 724. These systems 724, 722 would also be useful in conjunction with a temperature sensor 702 or a bottle security system comprising the proximity sensor 714 and the bottle lock 510. The security system would allow a user to secure the bottle or receive alerts if the bottle was removed from the chamber 12 without their knowledge.

Alternatively, the proximity sensor 714 may be used without the remote system 722 to enable activation of the apparatus 10 when a bottle is placed into the chamber 12. The proximity sensor 714 would be incorporated into the chamber wall 36 or base portion 38 and use infrared signals to gauge when an item was placed into the vessel 30. It may also be possible to implement this feature by incorporating a sensor that is sensitive to the weight of the bottle.

In addition to the LED board 108, a further LED or plurality of LEDs 718 may be incorporated beneath the optical element 114 that illuminate when the bezel 14 is touched during installation. The purpose of this would be to allow the installer to test touch inputs without having to activate the apparatus 10, and may be used before power has been supplied to the wider system.

The invention claimed is:

1. An apparatus for cooling bottled beverages, comprising:

a hang-off structure surrounding an access opening for receiving a bottle in use;

an open-topped vessel defining a bottle chamber accessible through the access opening, the open-topped vessel having a tubular wall coupled to the hang-off structure and a closed base opposed to the access opening;

a cooling device sandwiched between the closed base of the open-topped vessel and a heat exchanger such that the cooling device is in direct thermal communication with the closed base of the open-topped vessel, wherein the heat exchanger is suspended directly from the closed base of the open-topped vessel;

a tubular housing coupled to the hang-off structure, the tubular housing surrounding the open-topped vessel and enclosing the cooling device and the heat exchanger, wherein the hang-off structure projects radially outwardly of the tubular housing; and a fan configured to provide an air flow along an airflow path that extends from an inlet of the tubular housing and across the heat exchanger to an outlet of the tubular housing;

wherein the cooling device is held against the closed base of the open-topped vessel by the heat exchanger and the heat exchanger is suspended directly from the closed base by axially-extending fixings.

2. The apparatus of claim 1, wherein one of the inlet and the outlet extends through a tubular wall of the tubular housing and the other of the inlet and the outlet is surrounded by the tubular wall of the tubular housing.

3. The apparatus of claim 2, wherein one of the inlet and the outlet extends substantially continuously around the tubular wall of the tubular housing.

4. The apparatus of claim 2, further comprising an external duct coupled to and extending longitudinally from the tubular housing in communication with one of the inlet and the outlet that is surrounded by the tubular wall of the tubular housing.

5. The apparatus of claim 1, further comprising at least one air flow guide within the tubular housing, shaped such that the air flow followable along the airflow path from the inlet toward the outlet is deflected one of i) from substantially axial inward flow to cross-axial outward flow and ii) from cross-axial inward flow to substantially axial outward flow.

6. The apparatus of claim 1, wherein the inlet and the outlet both extend through a tubular wall of the tubular housing.

7. The apparatus of claim 6, wherein the inlet and the outlet are diametrically opposed about a longitudinal axis of the tubular housing.

8. The apparatus of claim 1, wherein at least one of the inlet and the outlet include a honeycomb array of substantially hexagonal apertures that penetrate the tubular housing.

9. The apparatus of claim 1, further comprising a frame coupled to the open-topped vessel and to the hang-off structure, and wherein the frame includes an annular flange that extends radially inwardly to cooperate with the open-topped vessel.

10. The apparatus of claim 9, wherein the open-topped vessel has a lip projecting radially outwardly from the tubular wall that hangs on the annular flange, wherein the lip is clamped between the hang-off structure and the annular flange.

11. An item of furniture, comprising an apparatus for cooling bottled beverages, the apparatus including:

a hang-off structure surrounding an access opening for receiving a bottle in use;

an open-topped vessel defining a bottle chamber accessible through the access opening, the open-topped vessel having a tubular wall coupled to the hang-off structure and a closed base opposed to the access opening;

a cooling device sandwiched between the closed base of the open-topped vessel and a heat exchanger such that the cooling device is in direct thermal communication with the closed base of the open-topped vessel, wherein the heat exchanger is suspended directly from the closed base of the open-topped vessel;

a tubular housing coupled to the hang-off structure, the tubular housing surrounding the open-topped vessel and enclosing the cooling device and the heat exchanger, wherein the hang-off structure projects radially outwardly of the tubular housing; and a fan configured to provide an air flow along an airflow path that extends from an inlet of the tubular housing, across the heat exchanger, to an outlet of the tubular housing;

wherein the cooling device is held against the closed base of the open-topped vessel by the heat exchanger and the heat exchanger is suspended directly from the closed base by axially-extending fixings.

12. The apparatus of claim 11, wherein one of the inlet and the outlet extends through a tubular wall of the tubular housing and the other of the inlet and the outlet is surrounded by the tubular wall of the tubular housing.

13. The apparatus of claim 12, wherein one of the inlet and the outlet extends substantially continuously around the tubular wall of the tubular housing.

14. The apparatus of claim 12, further comprising an external duct coupled to and extending longitudinally from the tubular housing in communication with one of the inlet and the outlet that is surrounded by the tubular wall of the tubular housing.

15. The apparatus of claim 11, further comprising at least one air flow guide within the tubular housing, shaped such that the air flow followable along the airflow path from the inlet toward the outlet is deflected one of i) from substantially axial inward flow to cross-axial outward flow and ii) from cross-axial inward flow to substantially axial outward flow.

16. The apparatus of claim 11, wherein the inlet and the outlet both extend through a tubular wall of the tubular housing.

17. The apparatus of claim 11, wherein at least one of the inlet and the outlet include a honeycomb array of substantially hexagonal apertures that penetrate the tubular housing.

18. An apparatus for cooling bottled beverages, comprising:

a hang-off structure surrounding an access opening for receiving a bottle in use;

an open-topped vessel defining a bottle chamber accessible through the access opening, the open-topped vessel having a tubular wall coupled to the hang-off structure and a closed base opposed to the access opening;

a cooling device sandwiched between the closed base of the open-topped vessel and a heat exchanger such that the cooling device is in direct thermal communication with the closed base of the open-topped vessel, wherein the heat exchanger is suspended directly from the closed base of the open-topped vessel;

a tubular housing coupled to the hang-off structure, the tubular housing surrounding the open-topped vessel and enclosing the cooling device and the heat exchanger, wherein the hang-off structure projects radially outwardly of the tubular housing;

a fan configured to provide an air flow along an airflow path that extends from an inlet of the tubular housing, across the heat exchanger, to an outlet of the tubular housing; and at least one air flow guide within the tubular housing, shaped such that the air flow followable along the airflow path from the inlet toward the outlet is deflected one of i) from substantially axial inward flow to cross-axial outward flow and ii) from cross-axial inward flow to substantially axial outward flow;

wherein at least one of the inlet and the outlet include a honeycomb array of substantially hexagonal apertures that penetrate the tubular housing;

wherein the cooling device is held against the closed base of the open-topped vessel by the heat exchanger and the heat exchanger is suspended directly from the closed base by axially-extending fixings.

19. The apparatus of claim 18, wherein one of the inlet and the outlet extends through a tubular wall of the tubular housing and the other of the inlet and the outlet is surrounded by the tubular wall of the tubular housing.

* * * * *